US008877415B2

(12) United States Patent
Yamashita et al.

(10) Patent No.: US 8,877,415 B2
(45) Date of Patent: Nov. 4, 2014

(54) TONER, METHOD OF MANUFACTURING TONER, DEVELOPER, TONER CONTAINER, IMAGE FORMING METHOD, AND PROCESS CARTRIDGE

(71) Applicants: Daiki Yamashita, Kanagawa (JP); Shinya Nakayama, Shizuoka (JP); Atsushi Yamamoto, Shizuoka (JP); Yukiko Nakajima, Kanagawa (JP); Akiyoshi Sabu, Shizuoka (JP); Yoshihiro Moriya, Shizuoka (JP); Hideyuki Santo, Kanagawa (JP)

(72) Inventors: Daiki Yamashita, Kanagawa (JP); Shinya Nakayama, Shizuoka (JP); Atsushi Yamamoto, Shizuoka (JP); Yukiko Nakajima, Kanagawa (JP); Akiyoshi Sabu, Shizuoka (JP); Yoshihiro Moriya, Shizuoka (JP); Hideyuki Santo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/760,529

(22) Filed: Feb. 6, 2013

(65) Prior Publication Data

US 2013/0244168 A1 Sep. 19, 2013

(30) Foreign Application Priority Data

Mar. 14, 2012 (JP) ..... 2012-058002

(51) Int. Cl.

| | |
|---|---|
| ***G03G 9/08*** | (2006.01) |
| ***G03G 15/08*** | (2006.01) |
| ***G03G 9/087*** | (2006.01) |
| ***G03G 21/18*** | (2006.01) |

(52) U.S. Cl.

CPC ..... *G03G 9/08755* (2013.01); *G03G 15/0832* (2013.01); *G03G 9/0819* (2013.01); *G03G 9/08795* (2013.01); *G03G 9/0825* (2013.01); *G03G 9/0804* (2013.01); *G03G 21/18* (2013.01); *G03G 9/08797* (2013.01)

USPC ..... 430/108.4; 430/109.1

(58) Field of Classification Search

CPC ..... G03G 9/08733; G03G 9/08755

USPC ..... 430/108.4, 109.1; 399/252

See application file for complete search history.

(56) References Cited

U.S. PATENT DOCUMENTS

| | | | |
|---|---|---|---|
| 2008/0280218 | A1 | 11/2008 | Sabu et al. |
| 2009/0003885 | A1 | 1/2009 | Sabu et al. |
| 2010/0104965 | A1 | 4/2010 | Inoue et al. |
| 2010/0183967 | A1 | 7/2010 | Sabu et al. |
| 2010/0216068 | A1 | 8/2010 | Kotsugai et al. |
| 2010/0330489 | A1 | 12/2010 | Inoue et al. |
| 2011/0065036 | A1 | 3/2011 | Inoue et al. |
| 2011/0104608 | A1 | 5/2011 | Nakajima et al. |
| 2011/0129775 | A1 * | 6/2011 | Sawada et al. ..... 430/109.2 |

(Continued)

FOREIGN PATENT DOCUMENTS

| | | |
|---|---|---|
| JP | 7-120975 | 5/1995 |
| JP | 9-274335 | 10/1997 |

(Continued)

*Primary Examiner* — Mark A Chapman

(74) *Attorney, Agent, or Firm* — Oblon, Spivak, McClelland, Maier & Neustadt, L.L.P.

(57) ABSTRACT

A toner including a resin particle (C) is provided. The resin particle (C) includes a resin particle (B) and; a resin particle (A) or covering layer (P) that is adhered to a surface of the resin particle (B). The resin particle (B) includes a resin (b) having a polyhydroxycarboxylic acid skeleton. The resin particle (A) or covering layer (P) includes a resin (a). The resin (a) is a polyester resin having a polybasic acid unit and a polyol unit and has a weight average molecular weight within a range from 9,500 to 100,000.

13 Claims, 2 Drawing Sheets

(56) References Cited

U.S. PATENT DOCUMENTS

| | | | |
|---|---|---|---|
| 2011/0281213 | A1 | 11/2011 | Sakashita et al. |
| 2012/0231383 | A1 | 9/2012 | Santo et al. |
| 2012/0295188 | A1 | 11/2012 | Nakajima et al. |
| 2013/0045442 | A1 | 2/2013 | Moriya et al. |

FOREIGN PATENT DOCUMENTS

| | | |
|---|---|---|
| JP | 2001-166537 | 6/2001 |
| JP | 2008-262179 | 10/2008 |
| JP | 2010-122667 | 6/2010 |

* cited by examiner

TONER, METHOD OF MANUFACTURING TONER, DEVELOPER, TONER CONTAINER, IMAGE FORMING METHOD, AND PROCESS CARTRIDGE

CROSS-REFERENCE TO RELATED APPLICATIONS

This patent application is based on and claims priority pursuant to 35 U.S.C. §119 to Japanese Patent Application No. 2012-058002, filed on Mar. 14, 2012, in the Japan Patent Office, the entire disclosure of which is hereby incorporated by reference herein.

BACKGROUND

1. Technical Field

The present disclosure relates to a toner, a method of manufacturing the toner, a developer including the toner, a toner container including the toner, an image forming method using the toner, and a process cartridge including the toner.

2. Description of Related Art

Toner for use in electrophotographic image forming apparatuses or electrostatic recording devices generally comprises colored particles in which colorants, charge controlling agents, etc., are dispersed in a binder resin. Toner is manufactured by various processes, such as pulverization process and suspension polymerization process.

Pulverization process can use only limited kinds of materials and cannot provide a high level of toner yield. It is generally difficult for pulverization processes to uniformly disperse colorants, charge controlling agents, etc., in thermoplastic binder resins. Therefore, a toner obtained by a pulverization process may be poor at fluidity, developability, durability, and image quality.

Binder resins generally occupy 70% or more of toner composition. Most binder resins are derived from petroleum resources now being exposed to depletion. Petroleum resources cause a problem of global warming because they discharge carbon dioxide into the air when consumed. On the other hand, binder resins derived from plant resources have been proposed and used for toners. Because plant resources have incorporated carbon dioxide from the air in the process of growing, carbon dioxide discharged from plant resources is merely circulated between the air and plant resources. Thus, plant resources have the potential to solve the problems of both depletion and global warming. JP-2909873-B2 (corresponding to JP-H07-120975-A), JP-H09-274335-A, and JP-2001-166537-A each describe a toner including a polylactic acid as a binder resin but the toner is obtained by a pulverization process.

Polylactic acid is obtainable by a dehydration condensation of lactic acid or a ring-opening polymerization of a cyclic lactide of lactic acid. Polylactic acid is adaptable for non-pulverization toner manufacturing processes in which a binder resin is dissolved in an organic solvent and the resulting solution is suspended in an aqueous medium (hereinafter "dissolution suspension processes"). Polylactic acids consisting of L-form or D-form have high crystallinity. Such polylactic acids are poorly soluble in organic solvents, and therefore they cannot be adaptable for the dissolution suspension processes. JP-2008-262179-A describes that a mixture of L-form and D-form polylactic acids has a lower crystallinity and an improved solubility in organic solvents. However, such a mixture of L-form and D-form polylactic acids may be still less stable in solubility than polyester resins that are soluble in ethyl acetate.

JP-2010-122667-A also describes a toner including a polylactic acid, but the toner also includes a styrene-acrylic resin.

SUMMARY

In accordance with some embodiments, a toner including a resin particle (C) is provided. The resin particle (C) includes a resin particle (B) and; a resin particle (A) or covering layer (P) that is adhered to a surface of the resin particle (B). The resin particle (B) includes a resin (b) having a polyhydroxycarboxylic acid skeleton. The resin particle (A) or covering layer (P) includes a resin (a). The resin (a) is a polyester resin having a polybasic acid unit and a polyol unit and has a weight average molecular weight within a range from 9,500 to 100,000.

In accordance with some embodiments, a method of manufacturing the above toner is provided. The method includes a step of preparing an aqueous dispersion (W) of the resin particle (A) including the resin (a). The method further includes a step of preparing an organic solvent solution or dispersion (O1) of the resin (b) or an organic solvent solution or dispersion (O2) of a precursor (b0) of the resin (b). The method further includes a step of dispersing the organic solvent solution or dispersion (O1) or (O2) in the aqueous dispersion (W) so that the resin particle (B) including the resin (b) is formed in the aqueous dispersion (W) and the resin particle (A) including the resin (a) is adhered to a surface of the resin particle (B). The method further includes a step of removing the organic solvent.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
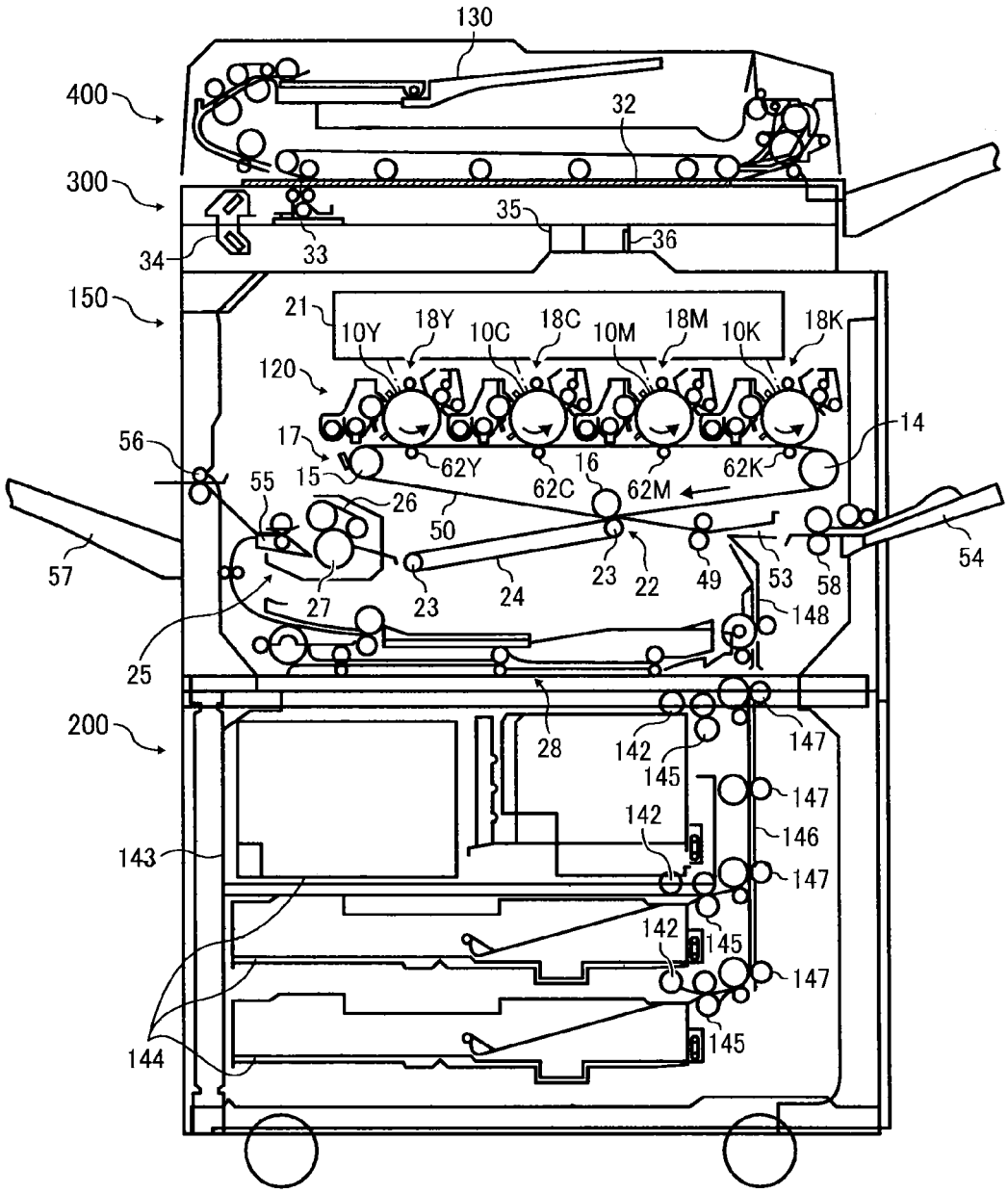
FIG. 1 is a schematic view of an image forming apparatus for which a toner according to an embodiment can be used.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

According to an embodiment, a toner comprising a resin particle (C) is provided. The resin particle (C) has one of the following structures (1) and (2).

(1) The resin particle (C) is comprised of a resin particle (B) including a resin (b) and a resin particle (A) including a resin (a). The resin particle (A) is adhered to a surface of the resin particle (B).

(2) The resin particle (C) is comprised of a resin particle (B) including a resin (b) and a covering layer (P) including a resin (a). The covering layer (P) is adhered to a surface of the resin particle (B). The covering layer (P) needs not cover the whole surface of the resin particle (B). In some embodiments, the covering layer (P) covers 95% or more of the whole surface of the resin particle (B).

The resin (b) has a polyhydroxycarboxylic acid skeleton. The resin (a) is a polyester resin obtained from a polybasic acid and a polyol. Thus, the polyester resin has a residue group of the polybasic acid (hereinafter "polybasic acid unit") and another residue group of the polyol (hereinafter "polyol unit"). The polyester resin has a weight average molecular weight (Mw) within a range from 9,500 to 100,000. When the polyester resin has an Mw of less than 9,500 and is used for the dissolution suspension process, fine particles of the polyester resin may be easily dissolved in an organic phase (i.e., ethyl acetate) at the time the organic phase is emulsified in an aqueous phase. This means that the fine particles of the polyester resin cannot stably exist at the interface between the organic and aqueous phases. As Mw increases, the solubility of the polyester resin in ethyl acetate decreases and the mobility of its molecules decreases. This means that the fine particles of the polyester resin can stably exist at the interface between the organic and aqueous phases. When Mw exceeds 100,000, the polyester resin may have too high a viscosity to be reliably formed into fine particles. Mw can be measured by gel permeation chromatography (GPC) with reference to a calibration curve complied from polystyrene standard samples having known molecular weights.

According to an embodiment, the resin (b) has a polyhydroxycarboxylic acid skeleton obtained from a polymerization or copolymerization of hydroxycarboxylic acids. The polyhydroxycarboxylic acid skeleton can be obtained by a direct hydrolysis condensation of hydroxycarboxylic acids or a ring-opening polymerization of cyclic esters of hydroxycarboxylic acids, for example. In some embodiments, the polyhydroxycarboxylic acid skeleton is obtained by a ring-opening polymerization of cyclic esters of hydroxycarboxylic acids. In such embodiments, molecular weight of the polyhydroxycarboxylic acid skeleton can be more increased.

Specific examples of usable hydroxycarboxylic acids include, but are not limited to, aliphatic hydroxycarboxylic acids (e.g., glycolic acid, lactic acid, hydroxybutyric acid), aromatic hydroxycarboxylic acids (e.g., salicylic acid, creosotic acid, mandelic acid, barrinic acid, syringic acid), and mixtures thereof. Specific examples of usable cyclic esters of these hydroxycarboxylic acids include, but are not limited to, glycolide, lactide, γ-butyrolactone, and 6-valerolactone.

In one or more embodiments, the polyhydroxycarboxylic acid skeleton is obtained from an aliphatic hydroxycarboxylic acid in view of transparency and thermal property of the resin particle (C). In some embodiments, the polyhydroxycarboxylic acid skeleton is obtained from a hydroxycarboxylic acid having 2 to 6 carbon atoms. In some embodiments, the polyhydroxycarboxylic acid skeleton is obtained from glycolic acid, lactic acid, glycolide, or lactide. In some embodiments, the polyhydroxycarboxylic acid skeleton is obtained from glycolic acid or lactic acid.

When cyclic esters of hydroxycarboxylic acids are used, the resulting polyhydroxycarboxylic acid skeleton has a configuration in which the hydroxycarboxylic acids are polymerized. For example, the polyhydroxycarboxylic acid skeleton obtained from lactic acid lactide has a configuration in which lactic acid is polymerized.

In some embodiments, the polyhydroxycarboxylic acid skeleton is obtained from optically-active monomers, such as lactic acid, having an optical purity X of 80% by mole or less or 60% by mol or less. The optical purity X is represented by the following formula:

$$X\,(\%\text{ by mole})=|X(L\text{-form})-X(D\text{-form})|$$

wherein X(L-form) and X(D-form) represent ratios (% by mole) of L-form and D-form optically-active monomers, respectively. When the optical purity is within the above range, solvent solubility and transparency of the resulting resin improve. Such a resin is useful in a toner manufacturing method (I) to be described later.

The resin (b) contributes to uniform dispersion of colorants and waxes in the toner. The resin (b) also contributes to improvement in image density and haze degree, even when the toner contains a colorant and a wax, because of having high transparency.

In some embodiments, the resin (b) includes a straight-chain polyester resin (b1) obtained by reacting a polyester diol (b11) having a polyhydroxycarboxylic acid skeleton with a polyester diol (b12) other than the polyester diol (b11) with an elongating agent. The straight-chain polyester resin (b1) is easy to control its molecular weight and properties (e.g., thermal properties, compatibility with other resins) owing to its simple structure. Properties of the straight-chain polyester resin (b1) can be controlled by varying chemical species, molecular weight, and/or molecular structure of the polyester diol (b12) as well as the polyester diol (b11).

Each of the polyester diol (b11), polyester diol (b12), and elongating agent is difunctional. When one of them is trifunctional or more functional, the resulting polyester resin does not have a straight-chain structure because cross-linking reaction excessively proceeds.

The polyester diol (b11) having a polyhydroxycarboxylic acid skeleton can be obtained by copolymerizing a hydroxycarboxylic acid with a diol (11). Specific examples of the diol (11) include, but are not limited to, 1,2-propylene glycol, 1,3-propylene glycol, 1,4-butanediol, 1,6-hexanediol, alkylene oxide ("AO") 2-30 mol adducts of bisphenols (e.g., bisphenol A, bisphenol F, bisphenol S), and combinations thereof. Specific examples of the alkylene oxides ("AO") include, but are not limited to, ethylene oxide ("EO"), propylene oxide ("PO"), and butylene oxide ("BO"). In some embodiments, 1,2-propylene glycol, 1,3-propylene glycol, 1,4-butanediol, or an AO adduct of bisphenol A is used. In some embodiments, 1,3-propylene glycol is used.

The polyester diol (b12) can be obtained by reacting the diol (11) with a dicarboxylic acid (13) while controlling the ratio between the diol (11) and the dicarboxylic acid (13) so that hydroxyl groups are excessive. Specific examples of the polyester diol (b12) include, but are not limited to, reaction products of at least one member selected from 1,2-propylene glycol, 1,3-propylene glycol, 1,4-butanediol, 1,6-hexanediol, and AO (e.g., EO, PO, BO) 2-30 mol adducts of bisphenols (e.g., bisphenol A, bisphenol F, bisphenol S) with at least one member selected from terephthalic acid, isophthalic acid, adipic acid, and succinic acid.

According to an embodiment, each of the polyester diol (b11) and polyester diol (b12) has a number average molecular weight (Mn) within a range from 500 to 30,000, from 1,000 to 20,000, or from 2,000 to 5,000, in view of controllability of properties of the straight-chain polyester resin (b1).

The elongating agent for elongating the polyester diol (b11) with the polyester diol (b12) is a compound having two functional groups each reactive with hydroxyl groups of the polyester diol (b11) and polyester diol (b12). Such a compound may be a difunctional dicarboxylic acid (13) or an anhydride thereof, a difunctional polyisocyanate (15), or a difunctional polyepoxide (19). In some embodiments, a diisocyanate compound or a dicarboxylic acid compound is used as the elongating agent in view of compatibility of the polyester diol (b11) with the polyester diol (b12). Specific examples of such difunctional compounds further include, but are not limited to, succinic acid, adipic acid, maleic acid (and anhydride thereof), fumaric acid (and anhydride thereof), phthalic acid, isophthalic acid, terephthalic acid, 1,3- and/or 1,4-phenylene diisocyanate, 2,4- and/or 2,6-tolylene diisocyanate ("TDI"), 2,4'- and/or 4,4'-diphenylmethane diisocyanate ("MDI"), hexamethylene diisocyanate ("RDI"), dicyclohexylmethane-4,4'-diisocyanate ("hydrogenated MDI"), isophorone diisocyanate ("IPDI"), and bisphenol A diglycidyl ether. In some embodiments, succinic acid, adipic acid, isophthalic acid, terephthalic acid, maleic acid (or anhydride thereof), fumaric acid (or anhydride thereof), HDI, or IPDI is used. In some embodiments, maleic acid (or anhydride thereof), fumaric acid (or anhydride thereof), or IPDI is used.

According to an embodiment, the content of the elongating agent in the straight-chain polyester resin (b1) is within a range from 0.1 to 30% by weight, or from 1 to 20% by weight, in view of transparency and thermal properties of the resin particle (C).

According to an embodiment, the content of the straight-chain polyester resin (b1) in the resin (b) is within a range from 40 to 100% by weight, or from 60 to 90% by weight, in view of transparency and thermal properties of the resin particle (C). In a case in which the straight-chain polyester resin (bp is obtained from an optically-active hydroxycarboxylic acid, such as lactic acid, and its optical purity X is 80% by mole or less, the content of the straight-chain polyester resin (b1) in the resin (b) may be within the range described above, in view of solvent solubility. By contrast, in a case in which its optical purity X is greater than 80% by mole, the content Y (% by weight) of the straight-chain polyester resin (b1) in the resin (b) and the optical purity X (% by mole) may satisfy the formula $Y \leq -1.5X+220$, in view of solvent solubility.

According to an embodiment, when reacting the polyester diol (b11) with the polyester diol (b12) to obtain the polyhydroxycarboxylic acid skeleton, the weight ratio of the polyester diol (b11) to the polyester diol (b12) is within a range from 31/69 to 90/10, or from 40/60 to 80/20, in view of transparency and thermal properties of the resin particle (C).

The resin (b) may further include a resin other than the straight-chain polyester resin (b1). Usable resins include, for example, a resin (b2) obtained by reacting a precursor (b0) during the formation process of the resin particle (C). Specific examples of the precursor (b0) and methods for obtaining the resin (b2) are described in detail later.

Usable resins further include, for example, vinyl resins, polyester resins, polyurethane resins, epoxy resins, and combinations thereof. In some embodiments, a polyurethane resin or a polyester resin is used. In some embodiments, a polyurethane or polyester resin having a unit of 1,2-propylene glycol is used.

According to an embodiment, the content of the resin other than the straight-chain polyester resin (b1) in the resin (b) is within a range from 0 to 60% by weight, or from 10 to 40% by weight, in view of transparency and thermal properties of the resin particle (C).

The resin (b) is variable in terms of number average molecular weight (Mn) (measured by GPC), melting point (measured by DSC), glass transition temperature (Tg), and solubility parameter (SP) (measured by a method disclosed in a document entitled "Polymer Engineering and Science", February, 1974, Vol. 14, No. 2, p. 147-154).

In some embodiments, the resin (b) has a number average molecular weight (Mn) within a range from 1,000 to 5,000,000, or from 2,000 to 500,000. In some embodiments, the resin (b) has a melting point within a range from 20 to 300° C., or from 80 to 250° C. In some embodiments, the resin (b) has a glass transition temperature (Tg) within a range from 20 to 200° C., or from 40 to 200° C. In some embodiments, the resin (b) has a solubility parameter (SP) within a range from 8 to 16, or from 9 to 14.

The glass transition temperature (Tg) can be measured with a differential scanning calorimeter (DSC) or a flowtester.

For example, Tg can be measured with an instrument DSC-20 SSC/580 from Seiko Instruments Inc. based on a method according to ASTM D3418-82 (i.e., DSC method). Also, Tg can be measured with a flowtester CFT-500 from Shimadzu Corporation under the following conditions.

Load: 30 kg/cm$^2$
Heating rate: 3.0° C./min
Die diameter: 0.50 mm
Die length: 10.0 mm In some embodiments, the resin (a) has an acid value within a range from 10 to 40 mgKOH/g, or from 10 to 35 mgKOH/g. When the acid value exceeds 40 mgKOH/g, the resulting covering layer may be poor at water resistance. When the acid value is less than 10 mgKOH/g, it means that the content of carboxyl groups, which contribute to hydrophilicity, is too small to prepare a reliable aqueous dispersion of the resin (a). In some embodiments, the resin (a) has a relative viscosity of 1.20 or more, which is measured at 20° C. by dissolving 1% by weight of the resin (a) in a mixed solvent in which an amount of phenol is mixed with the same amount of 1,1,2,2,-tetrachloroethane. When the relative viscosity is less than 1.20, the covering layer formed from an aqueous dispersion of the resin (a) may be poor at processability. In some embodiments, the resin (a) has a relative viscosity of 1.22 or more, or 1.24 or more. In some embodiments, the resin (a) has a relative viscosity of 1.95 or less. A polyester resin having a relative viscosity greater than 1.95 may be manufactured with poor operability. When the resin (a) has a relative viscosity greater than 1.95, an aqueous dispersion of the resin (a) may have abnormally high viscosity.

According to an embodiment, the resin (a) is inherently neither dispersible nor soluble in water and is obtained by reacting a polybasic acid with a polyol.

Specific examples of usable polybasic acids include, but are not limited to, aromatic dicarboxylic acids such as terephthalic acid, isophthalic acid, orthophthalic acid, naphthalenedicarboxylic acid, and biphenyl dicarboxylic acid. These polybasic acids can be used in combination with a small amount of 5-sulfoisophthalate sodium or 5-hydroxyisophthalic acid so long as water resistance does not deteriorate. Specific examples of usable polybasic acids further include, but are not limited to, aliphatic dicarboxylic acids such as saturated dicarboxylic acids (e.g., oxalic acid, succinic acid and anhydride thereof, adipic acid, azelaic acid, sebacic acid, dodecanedioic acid, hydrogenated dimer acid) and unsaturated dicarboxylic acids (e.g., fumaric acid, maleic acid and anhydride thereof, itaconic acid and anhydride thereof, citraconic acid and anhydride thereof, dimer acid). Specific examples of usable polybasic acids further include, but are not limited to, alicyclic dicarboxylic acids such as 1,4-cyclohexanedicarboxylic acid, 1,3-cyclohexanedicarboxylic acid, 1,2-cyclohexanedicarboxylic acid, 2,5-norbornenedicarboxylic acid and anhydride thereof, and tetrahydrophthalic acid and anhydride thereof.

In some embodiments, the total polybasic acids include aromatic polybasic acids in an amount of 50% by mole or more. When the amount of aromatic polybasic acid is less than 50% by mole, it means that more than the half of the resulting resin is occupied by the residue structures of aliphatic and alicyclic polybasic acids. Such a resin may form a covering layer with poor hardness, contamination resistance, and water resistance. Moreover, a water dispersion of such a resin may be poor at storage stability because hydrolysis resistance of the aliphatic and alicyclic ester bonds is poorer than that of the aromatic ester bonds. To secure storage stability of the water dispersion, in some embodiments, the total polybasic acids include aromatic polybasic acids in an amount of 70% by mole or more. To improve processability, water resistance, chemical resistance, and weather resistance of the resulting covering layer with balance, in some embodiments, the total polybasic acids include terephthalic acid in an amount of 65% by mole or more.

Specific examples of usable polyols include, but are not limited to, aliphatic glycols having 2 to 10 carbon atoms, alicyclic glycols having 6 to 12 carbon atoms, and glycols having ether bond.

Specific examples of the aliphatic glycols having 2 to 10 carbon atoms include, but are not limited to, ethylene glycol, 1,2-propylene glycol, 1,3-propanediol, 1,4-butanediol, 2-methyl-1,3-propanediol, 1,5-pentanediol, neopentyl glycol, 1,6-hexanediol, 3-methyl-1,5-pentanediol, 1,9-nonanediol, and 2-ethyl-2-butylpropanediol.

Specific examples of the alicyclic glycols having 6 to 12 carbon atoms include, but are not limited to, 1,4-cyclohexanedimethanol.

Specific examples of the glycols having ether bond include, but are not limited to, diethylene glycol, triethylene glycol, dipropylene glycol, and a glycol obtained by adding one to several moles of ethylene oxide or propylene oxide to two phenolic hydroxyl groups of a bisphenol (e.g., 2,2-bis(4-hydroxyethoxyphenyl)propane).

Specific examples of usable polyols further include, but are not limited to, polyethylene glycol, polypropylene glycol, and polytetramethylene glycol. In some embodiments, the content of the ether bond in the polyol is 10% by weight or less, or 5% by weight or less, because the ether structure degrades water resistance and weather resistance of the resin (a).

In some embodiments, the resin (a) is obtained from polyols including ethylene glycol and/or neopentyl glycol in an amount of 50% by mole or more, or 65% by mole or more. In such embodiments, the resin (a) has a balanced performance. In particular, ethylene glycol improves chemical resistance and neopentyl glycol improves weather resistance. Ethylene glycol and neopentyl glycol are industrially produced in large volume and are available at low cost.

In some embodiments, the resin (a) is obtained by copolymerizing trifunctional or more functional polybasic acid and/or polyol with the above-described polybasic acid and/or polyol. Specific examples of usable trifunctional or more functional polybasic acids include, but are not limited to, trimellitic acid and anhydride thereof, pyromellitic acid and anhydride thereof, benzophenonetetracarboxylic acid and anhydride thereof, trimesic acid, ethylene glycol bis(anhydrotrimellitate), glycerol tris(anhydrotrimellitate), and 1,2,3,4-butanetetracarboxylic acid. Specific examples of usable trifunctional or more functional polyols include, but are not limited to, glycerin, trimethylolethane, trimethylolpropane, and pentaerythritol. In the copolymerization, the ratio of the trifunctional or more functional polybasic acid and/or polyol is 10% by mole or less, or 5% by mole or less, based on the total polybasic acid and/or polyol. When the ratio is greater than 10% by mole, the resin (a) may not express high processability.

The following compounds are also usable for preparing the resin (a): fatty acids (e.g., lauric acid, myristic acid, palmitic acid, stearic acid, oleic acid, linoleic acid, linolenic acid) and ester-formable derivatives thereof; high-boiling-point monocarboxylic acids (e.g., benzoic acid, p-tert-butyl benzoic acid, cyclohexane acid, 4-hydroxyphenyl stearic acid); high-boiling-point monoalcohols (e.g., stearyl alcohol, 2-phenoxyethanol); and hydroxycarboxylic acids (e.g., ε-caprolactone, lactic acid, β-hydroxybutyric acid, p-hydroxybenzoic acid) and ester-formable derivatives thereof.

The resin (a), which is a polyester resin, can be prepared by the following methods (1) to (3), for example.

(1) Subject all monomers and/or lower polymers to an esterification reaction in an inert atmosphere at 180 to 250° C. for 2.5 to 10 hours and then a polycondensation reaction in the presence of a catalyst under a reduced pressure of 1 Torr or less at 220 to 280° C. until the melt viscosity attains a desired value, thus obtaining a polyester resin.

(2) Terminate the polycondensation reaction before the melt viscosity attains a desired value. React the reaction product with a chain extender selected from a polyfunctional epoxy compound, an isocyanate compound, or an oxazoline compound for a short time, thus obtaining a high-molecular-weight polyester resin.

(3) Proceed the polycondensation reaction until the melt viscosity exceeds a desired value. Further mix the reaction product with extra monomers and subject the mixture to a depolymerization in an inert atmosphere under normal or additional pressures, thus obtaining a polyester resin having a desired melt viscosity.

According to an embodiment, carboxyl groups more frequently exist on the ends of the resin chain rather than the backbone of the resin chain in view of water resistance of the covering layer to be formed. A certain amount of carboxyl groups can be introduced into the ends of the polyester resin chain without causing side reaction or gelation by: in the above method (1), adding a trifunctional or more functional polybasic acid after the polycondensation reaction is initiated, or adding an acid anhydride of a polybasic acid immediately before the polycondensation is terminated; in the above method (2), by extending low-molecular-weight polyester resin chains having terminal carboxyl groups with a chain extender; and in the above method (3), by using a polybasic acid as the depolymerization agent.

The polyester resin can be formed into an aqueous dispersion having a concentration of 0.5 to 50% by weight, or 1 to 40% by weight. Even when the concentration of the polyester resin is relatively high, i.e., exceeds 20% by weight, the aqueous dispersion keeps storage stability. When the concentration of the polyester resin exceeds 50% by weight, it may be difficult to form a reliable aqueous dispersion due to high viscosity.

According to an embodiment, the resin (a) is neutralized with a basic compound when being dispersed in an aqueous medium. Neutralization of carboxyl groups in the resin (a) provides impetus for forming an aqueous dispersion of the resin (a) particles. Moreover, the resulting resin (a) particles are prevented from aggregating by the combined effects of an electric repulsive force generated between carboxyl anions produced in the neutralization and the presence of a small amount of a compound having a protection colloid effect. The basic compound may be a compound which volatilizes upon formation the covering layer or upon mixing of a hardening agent to cause bake-hardening. Such compounds include, for example, ammonia and organic amine compounds having a boiling point of 250° C. or less. Specific examples of usable organic amine compounds include, but are not limited to, ethylamine, diethylamine, triethylamine, N,N-dimethylethanolamine, N,N-diethylethanolamine, aminoethanolamine, N-methyl-N,N-diethanolamine, propylamine, isopropylamine, iminobispropylamine, 3-ethoxypropylamine, 3-diethylaminopropylamine, sec-butylamine, methylaminopropylamine, dimethylaminopropylamine, methyliminobispropylamine, 3-methoxypropylamine, monoethanolamine, diethanolamine, triethanolamine, morpholine, N-methylmorpholine, and N-ethylmorpholine. According to an embodiment, the added amount of the basic compound is 0.2 to 1.5 times, or 0.4 to 1.3 times, equivalent of the carboxyl groups in the resin (a), so that at least a part of the carboxyl groups are neutralized. When the added amount is less than 0.2 times the equivalent, the basic compound cannot produce its effect. When the added amount is greater than 1.5 times the equivalent, the aqueous medium of the resin (a) may excessively increase its viscosity.

To accelerate formation of an aqueous dispersion of the resin (a) particles, an amphiphilic organic compound having polyester-plasticizing ability may be used in forming the aqueous dispersion of the resin (a) particles. It is to be noted that amphiphilic organic compounds having a boiling point greater than 250° C. are not usable because they are vaporized too slow to be completely removed from the resulting layer even by drying. Usable amphiphilic organic compounds include organic solvents having a boiling point of 250° C. or less with low toxicity, explosibility, and inflammability.

Usable organic solvents are those having both amphiphilicity and polyester-plasticizing ability. Usable amphiphilic organic solvents have a water solubility of 5 g/L or more, or 10 g/L or more, at 20° C. Organic solvents having a water solubility of less than 5 g/L are poor at accelerating formation of an aqueous dispersion of the resin (a) particles. Whether or not organic solvents have plasticizing ability can be determined by the following simple procedure. First, prepare a plate of a polyester resin with each side having a length of 3 cm and a thickness of 0.5 cm. Immerse the plate in 50 mL of an organic solvent and leave it for 3 hours under an atmosphere at 25 to 30° C. When the shape of the plate has clearly deformed after the 3-hour immersion, or when a stainless-steel round bar having a diameter of 0.2 cm is brought into contact with the plate in the thickness direction with a static force of 1 kg/cm$^2$ and the round bar intrudes into the plate for a depth of 0.3 cm or more, the organic solvent is regarded as having plasticizing ability. Organic solvents regarded as having no plasticizing ability are poor at accelerating formation of an aqueous dispersion of the resin (a) particles.

Specific examples of usable amphiphilic organic solvents include, but are not limited to, alcohols (e.g., ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-propanol, n-hexanol, cyclohexanol), ketones (e.g., methyl ethyl ketone, methyl isobutyl ketone, ethyl butyl ketone, cyclohexanone, isophorone), ethers (e.g., tetrahydrofuran, dioxane), esters (e.g., ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate, dimethyl carbonate), glycol derivatives (e.g., ethylene glycol, ethylene glycol monomethyl ether, ethylene glycol monoethyl ether, ethylene glycol monobutyl ether, ethylene glycol ethyl ether acetate, diethylene glycol, diethylene glycol monomethyl ether, diethylene glycol monoethyl ether, diethylene glycol monobutyl ether, diethylene glycol ethyl ether acetate, propylene glycol, propylene glycol monomethyl ether, propylene glycol monobutyl ether, propylene glycol methyl ether acetate), 3-methoxy-3-methylbutanol, 3-methoxybutanol, acetonitrile, dimethylformamide, dimethylacetamide, diacetone alcohol, and ethyl acetoacetate.

Two or more of these solvents can be used in combination.

When two or more of the above-described organic solvents which satisfy the following two conditions are used in combination, the formation of the aqueous dispersion can be more effectively accelerated and the storage stability of the aqueous dispersion can be more improved.

(Condition 1) Having a hydrophobic molecular structure in which 4 or more carbon atoms are directly bound to each other.

(Condition 2) Having a substitute group including one or more atoms having a Pauling's electronegativity of 3.0 or more on a molecular end, and the substitute group has a polarity such that a carbon atom which is bound to the atom having a Pauling's electronegativity of 3.0 or more exhibits a chemical shift of 50 ppm or more in $^{13}$C-NMR spectrum measured in $CDCl_3$ at room temperature.

The substitute group (defined in Condition 2) may be, for example, alcoholic hydroxyl group, methyl ether group, ketone group, acetyl group, or methyl ester group. Specific examples of the organic solvents satisfying the above two conditions include, but are not limited to, alcohols (e.g., n-butanol, isobutanol, sec-butanol, tert-butanol, n-amyl alcohol, isoamyl alcohol, sec-amyl alcohol, tert-amyl alcohol, n-hexanol, cyclohexanol), ketones (e.g., methyl isobutyl ketone, cyclohexanone), esters (e.g., n-butyl-acetate, isobutyl acetate, sec-butyl-acetate, 3-methoxybutyl-acetate), glycol derivatives (e.g., ethylene glycol monobutyl ether, diethylene glycol monobutyl ether, propylene glycol monobutyl ether), 3-methoxy-3-methylbutanol, and 3-methoxybutanol.

The organic solvents having a boiling point of 100° C. or less and those capable of forming an azeotropic mixture with water can be partially or completely removed from the reaction system (hereinafter a "stripping process") in the process of forming the aqueous dispersion or succeeding processes. In some embodiments, the content of the organic solvent in the resulting aqueous dispersion is within a range from 0.5 to 10% by weight, from 0.5 to 8.0% by weight, or from 1.0 to 5.0% by weight, based on the total weight of the aqueous medium. When the content is within a range from 0.5 to 10% by weight, the aqueous dispersion has excellent storage stability and layer formability. When the content is less than 0.5% by weight, it may take a long time to form the aqueous dispersion and the resulting polyester resin particles may not have a desired particle size distribution. When the content exceeds 10% by weight, the aqueous dispersion cannot be reliably formed. The content of undesirable secondary particles is increased and the viscosity of the aqueous dispersion is abnormally increased. The aqueous dispersion may have poor storage stability and layer formability.

In some embodiments, a compound having a protective colloid effect is used for the purpose of securely giving a certain level of stability to the aqueous dispersion during storage and the stripping process. The protective colloid effects here refers to a stabilization effect (i.e., a mixing effect, osmotic effect, or volume restriction effect) of a protection colloid being adsorbed to the surfaces of resin particles in an aqueous medium which prevents the resin particles from adsorbing to each other. Specific examples of such compounds having the protective colloid effect include, but are not limited to, polyvinyl alcohol, carboxymethyl cellulose, hydroxyethyl cellulose, hydroxypropyl cellulose, modified starch, polyvinyl pyrrolidone, polyacrylic acid, polymers of vinyl monomers including acrylic acid and/or methacrylic acid, polyitaconic acid, gelatin, gum arabic, casein, and swellable mica.

These compounds are water-soluble, or alternatively, these compounds partially neutralized with a basic compound get water-soluble. The basic compound may be ammonia or an organic amine compound so as not to degrade water resistance of the resulting covering layer. In some embodiments, the compound having the protective colloid effect has a number average molecular weight (Mn) of 1,500 or more, 2,000 or more, or 2,500 or more. In such embodiments, the compound expresses the protective colloid effect in small amounts without degrading water resistance and chemical resistance of the resulting covering layer.

In some embodiments, the used amount of the compound having the protective colloid effect is within a range from 0.01 to 3% by weight, or from 0.03 to 2% by weight, based on the weight of the polyester resin. Within the above range, the aqueous dispersion is drastically improved in stability during storage and its formation process while the resulting covering layer is not degraded. Use of the compound having the protective colloid effect also contributes to reduction of the acid value of the polyester resin and the content of the organic solvent. In some embodiments, the used amount of the compound having the protective colloid effect is 0.05% by weight or less, or 0.03% by weight or less, based on the weight of the polyester resin. When the used amount is less than 0.05% by weight, the aqueous dispersion is drastically improved in stability during storage and its formation process while the resulting covering layer is not degraded.

According to an embodiment, the resin particle (C) includes the resin particle (B) including the resin (b) and the resin particle (A) or covering layer (P) including the resin (a). The resin particle (A) or covering layer (P) is covering a surface of the resin particle (B).

The resin particle (C) can be prepared by the following method (I) or (II), for example.

(I) Mix an aqueous dispersion (W) of the resin particle (A) including the resin (a) with an organic solvent solution or dispersion (O1) of the resin (b) or an organic solvent solution or dispersion (O2) of the precursor (b0) of the resin (b) so that the organic solvent solution or dispersion (O1) or (O2) is dispersed in the aqueous dispersion (W) and the resin particle (B) including the resin (b) is formed in the aqueous dispersion (W).

In this method, the resin particle (A) or covering layer (P) is adhered to a surface of the resin particle (B) upon formation of the resin particle (B), thus preparing the aqueous dispersion (X) of the resin particle (C). The resin particle (C) is isolated by removing the aqueous media from the aqueous dispersion (X).

(II) Prepare the resin particle (B) including the resin (b) in advance and coat the resin particle (B) with a coating agent (W') including the resin (a).

The coating agent (W') may be either liquid or solid. Alternatively, the resin particle (B) may be coated with a precursor (a') of the resin (a) first, followed by formation of the resin (a) by a reaction. The resin particle (B) may be prepared by, for example, an emulsion polymerization aggregation process or a pulverization process. The coating method is not limited to a particular method. One coating method includes dispersing the resin particle (B) or a dispersion thereof in the aqueous dispersion (W) of the resin particle (A) including the resin (a). Another coating method includes pouring a solution of the resin (a) on the resin particle (B).

In some embodiments, upon formation of the resin particle (B) by dispersing the organic solvent solution or dispersion (O1) of the resin (b) or the organic solvent solution or dispersion (O2) of the precursor (b0) of the resin (b) in the aqueous dispersion (W) of the resin particle (A), the resin particle (A) is adsorbed to a surface of the resin particle (B) so as to prevent coalescence or fission of the resin particle (C) under high shearing force. In such embodiments, the particle diameter distribution of the resin particle (C) is more narrowed. In such embodiments, the resin particle (A) has enough strength not to be destroyed by shearing force at a temperature at which the organic solvent solution or dispersion (O1) or (O2) is dispersed in the aqueous dispersion (W). The resin particle (A) is poorly soluble or swellable in water. Also, the resin particle (A) is poorly soluble in the resin (b) or the organic solvent solution or dispersion (O1) thereof, or the resin (b) and precursor (b0) or the organic solvent solution or dispersion (O2) thereof. Other toner constituents, such as a colorant, a release agent, and a modified layered inorganic mineral, are contained in the resin particle (B). To make toner constituents contained in the resin particle (B), the toner constituents are previously dispersed in the organic solvent solution or dispersion (O1) or (O2) before the organic solvent solution or dispersion (O1) or (O2) is mixed with the aqueous dispersion (W). A charge controlling agent may be either contained in the resin particle (B) or externally added. In the former case, the charge controlling agent is previously dispersed in the organic solvent solution or dispersion (O1) or (O2) before the organic solvent solution or dispersion (O1) or (O2) is mixed with the aqueous dispersion (W). In the latter case, the charge controlling agent is externally added the resin particle (C).

The resin (a) may be adjusted in terms of molecular weight, solubility parameter (SP), crystallinity, molecular weight between cross-linking points, etc., so that the resin particle (A) gets less soluble or swellable in water and solvents.

Number average molecular weight (Mn) and weight average molecular weight (Mw) of THF-soluble components in resins other than polyurethane resins can be measured by gel permeation chromatography (GPC) under the following conditions, for example.

Instrument: HLC-8120 from TOSOH CORPORATION
Columns: TSKgel GMHXL×2, TSKgel Multipore HXL-M×1
Sample solution: 0.25% THF solution
Injection volume: : 100 μL
Flow rate: 1 mL/min
Measuring temperature: 40° C.
Detector: Refractive index detector
Reference substance: TSK standard POLYSTYRENE from TOSOH CORPORATION (having a molecular weight of 500, 1,050, 2,800, 5,970, 9,100, 18,100, 37,900, 96,400, 190,000, 355,000, 1,090,000, and 2,890,000)

Number average molecular weight (Mn) and weight average molecular weight (Mw) of polyurethane resins can be measured by gel permeation chromatography (GPC) under the following conditions, for example.

Instrument: HLC-8220GPC from TOSOH CORPORATION
Columns: Guardcolumn α, TSKgel α-M
Sample solution: 0.125% dimethylformamide solution
Injection volume: 100 μL
Flow rate: 1 mL/min
Measuring temperature: 40° C.
Detector: Refractive index detector
Reference substance: TSK standard POLYSTYRENE from TOSOH CORPORATION (having a molecular weight of 500, 1,050, 2,800, 5,970, 9,100, 18,100, 37,900, 96,400, 190,000, 355,000, 1,090,000, and 2,890,000)

In some embodiments, the resin (a) has a glass transition temperature (Tg) within a range from 50 to 100° C., from 51 to 90° C., or from 52 to 75° C., in view of particle size distribution, fluidity, heat-resistant storage stability, and stress resistance of the resin particle (C). When Tg of the resin (a) is lower than the temperature at which the aqueous dispersion thereof is prepared, coalescence or fission of the resulting particle (C) cannot be sufficiently prevented and therefore particle size distribution of the resin particle (C) may be widened. For the same reason, in some embodiments, the resin particle (A) or covering layer (P) including the resin (a) has a glass transition temperature (Tg) within a range from 20 to 200° C., from 30 to 100° C., or from 40 to 85° C.

The glass transition temperature (Tg) of the resin (a) can be easily controlled by varying the molecular weight and/or monomer composition of the resin (a). The molecular weight of the resin (a) can be controlled by varying the ratio of monomers to be polymerized. Generally, the greater the molecular weight, the greater the glass transition temperature.

The aqueous dispersion (W) of the resin particle (A) may further include a water-miscible organic solvent (e.g., acetone, methyl ethyl ketone). Usable water-miscible organic solvents include those which do not cause aggregation of the resin particle (A), do not dissolve the resin particle (A), and do not prevent formation of the resin particle (C). The content of the water-miscible organic solvent may be 40% by weight or less based on the total weight of the aqueous medium. The water-miscible organic solvent may not remain in the resin particle (C) having been dried.

In some embodiments, the organic solvent solution or dispersion (O1) of the resin (b) or the organic solvent solution or dispersion (O2) of the precursor (b0) of the resin (b) includes an organic solvent (u). In some embodiments, the organic solvent (u) is added to the aqueous dispersion (W) of the resin particle (A) at the time the organic solvent solution or dispersion (O1) or (O2) is dispersed in the aqueous dispersion (W). Specific examples of the organic solvent (u) include, but are not limited to, aromatic hydrocarbon solvents (e.g., toluene, xylene, ethylbenzene, tetralin), aliphatic or alicyclic hydrocarbon solvents (e.g., n-hexane, n-heptane, mineral spirit cyclohexane), halogen solvents (e.g., methyl chloride, methyl bromide, methyl iodide, methylene dichloride, carbon tetrachloride, trichloroethylene, perchloroethylene), ester ether solvents (e.g., ethyl acetate, butyl acetate, methoxybutyl acetate, methyl cellosolve acetate, ethyl cellosolve acetate), ether solvents (e.g., diethyl ether, tetrahydrofuran dioxane, ethyl cellosolve, butyl cellosolve, propylene glycol monomethyl ether), ketone solvents (e.g., acetone, methyl ethyl ketone, methyl isobutyl ketone, di-n-butyl ketone, cyclohexanone), alcohol solvents (e.g., methanol, ethanol, n-propanol, isopropanol, n-butanol, isobutanol, t-butanol, 2-ethylhexyl alcohol, benzyl alcohol), amide solvents (e.g., dimethylformamide, dimethylacetamide), sulfoxide solvents (e.g., dimethylsulfoxide), and heterocyclic solvents (e.g., N-methylpyrrolidone). Two or more of these solvents can be used in combination.

In some embodiments, the organic solvent solution or dispersion (O1) of the resin (b) or the organic solvent solution or dispersion (O2) of the precursor (b0) of the resin (b) includes a plasticizer (v). In some embodiments, the plasticizer (v) is added to the aqueous dispersion (W) of the resin particle (A) at the time the organic solvent solution or dispersion (O1) or (O2) is dispersed in the aqueous dispersion (W). Specific examples of the plasticizer (v) include, but are not limited to, (v1) phthalates (e.g., dibutyl phthalate, dioctyl phthalate, butyl benzyl phthalate, diisodecyl phthalate), (v2) aliphatic dibasic acid esters (e.g., di-2-ethylhexyl adipate, 2-ethylhexyl sebacate), (v3) trimellitates (e.g., tri-2-ethylhexyl trimellitate, trioctyl trimellitate), (v4) phosphates (e.g., triethyl phosphate, tri-2-ethylhexyl phosphate, tricresyl phosphate), (v5) fatty acid esters (e.g., butyl oleate), and (v6) mixtures of two or more of the above compounds.

According to an embodiment, the particle diameter of the resin particle (A) is smaller than that of the resin particle (B). In one or more embodiments, the ratio of the volume average particle diameter of the resin particle (A) to that of the resin particle (B) is within a range from 0.001 to 0.3, or from 0.003 to 0.25. When the volume average particle diameter ratio exceeds 0.3, the resin particle (A) may adsorb to the resin particle (B) with a low efficiency. As a result, the particle size distribution of the resin particle (C) gets wider.

The volume average particle diameter of the resin particle (A) is adjusted so that the resin particle (C) has a desired particle diameter. In one or more embodiments, the volume average particle diameter of the resin particle (A) is within a range from 0.0005 to 1 μm. In some embodiments, the upper limit of the volume average particle diameter of the resin particle (A) is 0.75 μm or 0.5 μm and the lower limit thereof is 0.01 μm, 0.02 μm, or 0.04 μm. For example, to obtain the resin particle (C) having a volume average particle diameter of 1 μm, the volume average particle diameter of the resin particle (A) is adjusted to be within a range from 0.0005 to 0.30 μm, or from 0.001 to 0.2 μm. To obtain the resin particle (C) having a volume average particle diameter of 10 μm, the volume average particle diameter of the resin particle (A) is adjusted to be within a range from 0.005 to 0.8 μm, or from 0.05 to 1 μm. The volume average particle diameter can be measured with an instrument such as Particle Size Distribution Analyzer LA-920 (from HORIBA, Ltd.), Multisizer III (from Beckman Coulter, Inc.), or ELS-800 (from Otsuka Electronics Co., Ltd.) employing a laser Doppler optical system. In some embodiments, the volume average particle diameter of the resin particle (B) is within a range from 0.1 to 15 μm, from 0.5 to 10 μm, or from 1 to 8 μm.

The precursor (b0) of the resin (b2) may be, for example, a combination of a prepolymer (α) having a reactive group with a hardener (β). Here, the reactive group is defined as a group reactive with the hardener (β). The resin particle (B) including the resin (b2), obtained from the precursor (b0), can be prepared by: dispersing an oily liquid including the prepolymer (α) having a reactive group, the hardener (β), and an optional organic solvent (u) in an aqueous dispersion of the resin particle (A) and applying heat thereto to initiate a reaction between the prepolymer (α) and the hardener (β); dispersing the prepolymer (α) having a reactive group or an organic solvent solution or dispersion thereof in an aqueous dispersion of the resin particle (A) and further adding the hardener (β) which is water-soluble thereto to initiate a reaction between the prepolymer (α) and the hardener (β); or dispersing the prepolymer (α) having a reactive group which is hardenable by water or an organic solvent solution or dispersion thereof in an aqueous dispersion of the resin particle (A) to initiate a reaction between the prepolymer (α) and water.

Specific combinations of the prepolymer (α) and the hardener (β) include the following combinations (1) and (2), for example.

(1) The prepolymer (α) is that having a functional group (α1) reactive with a compound having an active hydrogen group and the hardener (β) is a compound (β1) having an active hydrogen group.

(2) The prepolymer (α) is that having an active hydrogen group (α2) and the hardener (β) is a compound (β2) reactive with an active hydrogen group.

In the above combination (1), the functional group (α1) reactive with a compound having an active hydrogen group may be, for example, an isocyanate group (α1a), a blocked isocyanate group (α1b), an epoxy group (α1c), an acid anhydride group (α1d), or an acid halide group (α1e). In some embodiments, an isocyanate group (α1a), a blocked isocyanate group (α1b), or an epoxy group (α1c) is employed. In some embodiments, an isocyanate group (α1a) or a blocked isocyanate group (α1b) is employed. The blocked isocyanate group (α1b) is defined as an isocyanate group blocked with a blocking agent. Specific materials usable as the blocking agent include, but are not limited to, oximes (e.g., acetoxime, methyl isobutyl ketoxime, diethyl ketoxime, cyclopentanone oxime, cyclohexanone oxime, methyl ethyl ketoxime), lactams (e.g., γ-butyrolactam, ε-caprolactam, γ-valerolactam), aliphatic alcohols having 1 to 20 carbon atoms (e.g., methanol, ethanol, octanol), phenols (e.g., phenol, cresol, xylenol, nonylphenol), active methylene compounds (e.g., acetylacetone, ethyl malonate, ethyl acetoacetate), basic nitrogen-containing compounds (e.g., N,N-diethylhydroxylamine,2-hydroxypyridine, pyridine-N-oxide, 2-mercaptopyridine), and mixtures thereof. In some embodiments, an oxime is used. In some embodiments, methyl ethyl oxime is used.

The prepolymer (α) having a reactive group may comprise a polyether (αw) skeleton, a polyester (αx) skeleton, an epoxy resin (αy) skeleton, or a polyurethane (αz) skeleton. In some embodiments, a polyester (αx) skeleton, an epoxy (αy) skeleton, or a polyurethane (αz) skeleton is employed. In some embodiments, a polyester (αx) skeleton or a polyurethane (αz) skeleton is employed. The polyether (αw) may be, for example, polyethylene oxide, polypropylene oxide, polybutylene oxide, or polytetramethylene oxide. The polyester (αx) may be, for example, a polycondensation product of a diol (11) with a dicarboxylic acid (13) or a polylactone (i.e., a ring-opening polymerization product of ε-caprolactone). The epoxy resin (αy) may be, for example, an addition condensation product of a bisphenol (e.g., bisphenol A, bisphenol F, bisphenol S) with epichlorohydrin. The polyurethane (αz) may be, for example, a polyaddition product of a diol (11) with a polyisocyanate (15) or a polyaddition product of the polyester (αx) with a polyisocyanate (15).

A reactive group can be introduced to the polyester (αx), epoxy resin (αy), or polyurethane (αz) by the following methods [1] and [2]. [1] React two or more components with one particular component being excessive so that a functional group of the particular component remains on a terminal. [2] React two or more components with one particular component being excessive so that a functional group of the particular component remains on a terminal, and further react the remaining functional group with a compound having both a functional group reactive with the remaining functional group and a reactive group.

The above method [1] can produce, for example, a polyester prepolymer having a hydroxyl group, a polyester prepolymer having a carboxyl group, a polyester prepolymer having an acid halide group, an epoxy resin prepolymer having a hydroxyl group, an epoxy resin prepolymer having an epoxy group, a polyurethane prepolymer having a hydroxyl group, and a polyurethane prepolymer having an isocyanate group. For example, a polyester prepolymer having a hydroxyl group can be obtained by reacting a polyol (1) with a polycarboxylic acid (2) with the equivalent ratio [OH]/[COOH] of hydroxyl groups [OH] from the polyol (1) to carboxyl groups [COOH] from the polycarboxylic acid (2) being within a range from 2/1 to 1/1, from 1.5/1 to 1/1, or from 1.3/1 to 1.02/1.

In the above method [2], for example, a prepolymer having an isocyanate group, a prepolymer having a blocked isocyanate group, a prepolymer having an epoxy group, and a prepolymer having an acid anhydride group can be produced by reacting the prepolymer produced by the method [1] with a polyisocyanate, a blocked polyisocyanate, a polyepoxide, and a poly(acid anhydride), respectively. For example, a polyester prepolymer having an isocyanate group can be obtained by reacting a polyester having a hydroxyl group with a polyisocyanate with the equivalent ratio [NCO]/[OH] of isocyanate groups [NCO] from the polyisocyanate to hydroxyl groups [OH] from the polyester having hydroxyl group being within a range from 5/1 to 1/1, from 4/1 to 1.2/1, or from 2.5/1 to 1.5/1.

In some embodiments, the average number of reactive groups included in one molecule of the prepolymer (α) is 1 or more, within a range from 1.5 to 3, or within a range from 1.8 to 2.5. Within the above range, the reaction product of the prepolymer (α) having a reactive group with the hardener (β) has a relatively high molecular weight. In some embodiments, the prepolymer (α) having a reactive group has a number average molecular weight (Mn) within a range from 500 to 30,000, from 1,000 to 20,000, or from 2,000 to 10,000. In some embodiments, the prepolymer (α) having a reactive group has a weight average molecular weight (Mw) within a range from 1,000 to 50,000, from 2,000 to 40,000, or from 4,000 to 20,000. In some embodiments, the prepolymer (α) having a reactive group has a viscosity of 2,000 poise or less, or 1,000 poise or less, at 100° C. When the viscosity is 2,000 poise or less, the resin particle (C) having a narrow size distribution can be obtained with use of a small amount of organic solvents.

The compound (β1) having an active hydrogen group may be, for example, a polyamine (β1a) which may be blocked with a releasable compound, a polyol (β1b), a polymercaptan (β1c), and water (β1d). In some embodiments, a polyamine (β1a) which may be blocked with a releasable compound, a polyol (β1b), or water (β1d) is used. In some embodiments, a polyamine (β1a) which may be blocked with a releasable compound or water (β1d) is used. In some embodiments, a blocked polyamine or water (β1d) is used. The polyamine (β1a) may be, for example, a polyamine (16). The polyamine (β1a) may be, for example, 4,4'-diaminodiphenylmethane, xylylenediamine, isophoronediamine, ethylenediamine, diethylenetriamine, triethylenetetramine, or a mixture thereof.

The polyamine (β1a) which is blocked with a releasable compound may be, for example, a ketimine compound obtained from a polyamine and a ketone having 3 to 8 carbon atoms (e.g., acetone, methyl ethyl ketone, methyl isobutyl ketone), an aldimine compound obtained from an aldehyde compound having 2 to 8 carbon atoms (e.g., formaldehyde, acetaldehyde), an enamine compound, or an oxazoline compound.

The polyol (β1b) may be, for example, the diol (11) or the polyol (12). In some embodiments, the diol (11) alone or a mixture of the diol (11) with a small amount of the polyol (12) is employed. The polymercaptan (β1c) may be, for example, ethylenedithiol, 1,4-butanedithiol, or 1,6-hexanedithiol.

A reaction terminator (βs) may be optionally used in combination with the compound (β1) having an active hydrogen group. Combination use of the reaction terminator (βs) and the compound (β1) having an active hydrogen group at a specific ratio properly adjusts the molecular weight of the resulting resin. Specific examples of the reaction terminator (βs) include, but are not limited to, monoamines (e.g., diethylamine, dibutylamine, laurylamine, monoethanolamine, diethanolamine), blocked monoamines (e.g., ketimine compounds), monools (e.g., methanol, ethanol, isopropanol, butanol, phenol), monomercaptans (e.g., butylmercaptan, laurylmercaptan), monoisocyanates (e.g., lauryl isocyanate, phenyl isocyanate), and monoepoxides (e.g., butyl glycidyl ether).

In the above combination (2), the active hydrogen group (α2) in the prepolymer (α) may be, for example, an amino group (α2a), a hydroxyl group (α2b) (e.g., an alcoholic hydroxyl group, a phenolic hydroxyl group), a mercapto group (α2c), a carboxyl group (α2d), or an organic group (α2e) blocked with a releasable compound. In some embodiments, an amino group (α2a), a hydroxyl group (α2b), or an organic group (α2e) which is an amino group blocked with a releasable compound is employed. In some embodiments, a hydroxyl group (α2b) is employed. Specific examples of the organic group (α2e) which is an amino group blocked with a releasable compound include, for example, those of the polyamine (β1a) which may be blocked with a releasable compound.

The compound (β2) reactive with an active hydrogen group may be, for example, a polyisocyanate (β2a), a polyepoxide (β2b), a polycarboxylic acid (β2c), a polycarboxylic acid anhydride (β2d), or a poly acid halide (β2e). In some embodiments, a polyisocyanate (β2a) or a polyepoxide (β2b) is employed. In some embodiments, a polyisocyanate (β2a) is employed.

The polyisocyanate (β2a) may be, for example, a polyisocyanate (15). The polyepoxide (β2b) may be, for example, a polyepoxide (19).

The polycarboxylic acid (β2c) may be, for example, a dicarboxylic acid (β2c-1) or a polycarboxylic acid (β2c-2) having 3 or more valences. In some embodiments, the dicarboxylic acid (β2c-1) alone or a mixture of the dicarboxylic acid (β2c-1) with a small amount of the polycarboxylic acid (β2c-2) having 3 or more valences is employed. The dicarboxylic acid (β2c-1) may be, for example, a dicarboxylic acid (13). The polycarboxylic acid (β2c-2) having 3 or more valences may be, for example, a polycarboxylic acid (5).

The polycarboxylic acid anhydride (β2d) may be, for example, a pyromellitic acid anhydride.

The poly acid halide (β2e) may be, for example, an acid halide (e.g., acid chloride, acid bromide, acid iodide) of the polycarboxylic acid (β2c). The reaction terminator (βs) may be optionally used in combination with the compound (β2) reactive with an active hydrogen group.

In some embodiments, the ratio [α]/[β] of the equivalent amount [α] of reactive groups in the prepolymer (α) to the equivalent amount [β] of active hydrogen groups in the hardener (β) is within a range from 1/2 to 2/1, from 1.5/1 to 1/1.5, or from 1.2/1 to 1/1.2. The water (β1d) as the hardener (β) is regarded as a divalent compound having an active hydrogen group.

The resin (b2) is obtained by reacting the precursor (b0), i.e., by reacting the prepolymer (α) having a reactive group with the hardener (β), in an aqueous medium. As a result, the resin (b2) is included in the resin particle (B) and further included in the resin particle (C). In some embodiments, the resin (b2) obtained by reacting the prepolymer (α) having a reactive group with the hardener (β) has a weight average molecular weight (Mw) of 3,000 or more, within a range from 3,000 to 10,000, or within a range from 5,000 to 1,000,000. In some embodiments, a dead polymer that is unreactive with either the prepolymer (α) having a reactive group or the hardener (β), such as the straight-chain polyester resin (b1), is added to the reaction system in which the prepolymer (α) having a reactive group is reacted with the hardener (β) in an aqueous medium. In such embodiments, the resulting resin is a mixture of the straight-chain polyester resin (β1) and the resin (b2) obtained from a reaction between the prepolymer (α) having a reactive group and the hardener (β).

According to an embodiment, the used amount of the aqueous dispersion (W) is within a range from 50 to 2,000 parts by weight, or from 100 to 1,000 parts by weight, based on 100 parts by weight of the resin (b). When the used amount of the aqueous dispersion (W) is 50 parts by weight or more, dispersion condition is good. The used amount of the aqueous dispersion (W) of 2,000 parts by weight or less results in reduction of cost.

The resin particle (C) can be obtained by mixing an aqueous dispersion (W) of the resin particle (A) including the resin (α) with an organic solvent solution or dispersion (O1) of the resin (b) or an organic solvent solution or dispersion (O2) of the precursor (b0) of the resin (b) so that the organic solvent solution or dispersion (O1) or (O2) is dispersed in the aqueous dispersion (W). The precursor (b0) is subject to a reaction for producing the resin (b2). As a result, an aqueous dispersion (X) of the resin particle (C), having a configuration in which the resin (α) is adhered to a surface of the resin particle (B) including the resin (b), is obtained. The resin particle (C) is isolated by removing the aqueous medium from the aqueous dispersion (X). The resin (α) adhered to a surface of the resin particle (B) may take the form of either the resin particle (A) or the covering layer (P). Whether the resin (α) takes the form of the resin particle (A) or the covering layer (P) depends on the glass transition temperature of the resin (α) and/or manufacturing conditions (e.g., solvent removing temperature) of the resin particle (C).

When the resin particle (C) is obtained by the above-described method (I), the particle shape and surface property of the resin particle (C) can be controlled by varying the solubility parameter difference between the resins (a) and (b) or the molecular weight of the resin (a). When the solubility parameter difference between the resins (a) and (b) is relatively small, it is likely that the resulting particles have irregular shapes and smooth surfaces. When the solubility parameter difference between the resins (a) and (b) is relatively large, it is likely that the resulting particles have spherical shapes and rough surfaces. When the molecular weight of the resin (a) is relatively large, it is likely that the resulting particles have rough surfaces. When the molecular weight of the resin (a) is relatively small, it is likely that the resulting particles have smooth surfaces. When the solubility parameter difference between the resins (a) and (b) is too small or large, it may be difficult to produce particles. When the molecular weight of the resin (a) is too small, it may be difficult to produce particles. In some embodiments, the solubility parameter difference between the resins (a) and (b) is within a range from 0.01 to 5.0, from 0.1 to 3.0, or from 0.2 to 2.0.

When the resin particle (C) is obtained by the above-described method (II), the shape of the resin particle (C) largely depends on the shape of the resin particle (B), and the resin particle (C) has substantially the same shape as the resin particle (B). However, even in a case in which the resin particle (B) has an irregular shape, the resin particle (C) can have a spherical shape by coating the resin particle (B) with a large amount of the coating agent (W').

According to an embodiment, the resin particle (C) includes 0.01 to 60% by weight of the resin particle (A) or covering layer (P) including the resin (a) and 40 to 99.99% of the resin particle (B) including the resin (b), in view of particle diameter distribution and storage stability of the resin particle (C). In some embodiments, the resin particle (C) includes 0.1 to 50% by weight of the resin particle (A) or covering layer (P) and 50 to 99.9% of the resin particle (B). In some embodiments, the resin particle (C) includes 1 to 45% by weight of the resin particle (A) or covering layer (P) and 55 to 99% of the resin particle (B). When the amount of the resin particle (A) or covering layer (P) including the resin (a) is 0.01% by weight or more, blocking resistance is good. When the amount of the resin particle (A) or covering layer (P) including the resin (a) is 60% by weight or less, low-temperature fixability is good.

According to an embodiment, 5% or more, 30% or more, 50% or more, or 80% or more of the surface of the resin particle (B) is covered with the resin particle (A) or covering layer (P) including the resin (a), in view of particle diameter distribution, powder fluidity, and storage stability of the resin particle (C).

The surface coverage of the resin particle (C) can be determined by analyzing a scanning electron microscope (SEM) image of the particle (C) according to the following formula.

Surface coverage (%)=(Area covered with resin particle (*A*) or covering layer (*P*))/[(Area covered with resin particle (*A*) or covering layer (*P*))+(Area exposing resin particle (*B*))]×100

According to an embodiment, the variation coefficient of the volume distribution of the resin particle (C) is 30% or less, or within a range from 0.1 to 15%, in view of particle diameter distribution of the resin particle (C). According to an embodiment, the ratio of the volume average particle diameter (Dv) to the number average particle diameter (Dn) of the resin particle (C) is within a range from 1.0 to 1.4, or from 1.0 to 1.3, in view of particle diameter distribution of the resin particle (C). According to an embodiment, the resin particle (C) has a volume average particle diameter within a range from 0.1 to 16 μm, from 0.5 to 11 μm, or from 1 to 9 μm. The volume average particle diameter and number average particle diameter can be simultaneously measured by an instrument Multisizer III (from Beckman Coulter, Inc.).

Concavities and convexities may be formed on the surface of the resin particle (C), if desired, by varying the particle diameters of the resin particle (A) and/or resin particle (B), or the surface coverage of the resin particle (B) with the covering layer (P). In some embodiments, the resin particle (C) has a BET specific surface area within a range from 0.5 to 5.0 $m^2/g$, in view of powder fluidity. BET specific surface area can be measured with a surface area meter QUANTASORB (from Yuasa Ionics Co., Ltd.) using a mixed gas of He/Kr (99.9/0.1 by volume) as a measurement gas and nitrogen gas as a detention gas.

In some embodiments, the resin particle (C) has a center line average surface roughness Ra within a range from 0.01 to 0.8 μm, in view of powder fluidity. Ra is an arithmetical mean value of absolute deviation values between a surface profile curve and the center line. Ra can be measured with a scanning probe microscopic system (from TOYO Corporation).

In some embodiments, the resin particle (C) has a spherical shape in view of power fluidity and melt leveling property. In such embodiments, the resin particle (B) may also have a spherical shape. In some embodiments, the resin particle (C) has an average circularity within a range from 0.95 to 1.00, from 0.96 to 1.00, or from 0.97 to 1.00. The average circularity is obtained by optically detecting projected images of particles, dividing the peripheral length of the circle having the same area as each projected image by the peripheral length of the projected image, and averaging all the data. The average circularity can be measured by a flow-type particle image analyzer FPIA-2000 (from Sysmex Corporation) as follows. Place 100 to 150 mL of water from which solid impurities have been removed in a container and add 0.1 to 0.5 mL of a surfactant (DRYWELL from FUJIFILM Corporation) and 0.1 to 9.5 g of a sample thereto. Subject the resulting suspension to a dispersion treatment with an ultrasonic disperser (Ultrasonic Cleaner Model VS-150 from VELVO-CLEAR) for about 1 to 3 minutes. Subject the suspension including 3,000 to 10,000 particles per micro-liter to a measurement of shape distribution of the sample.

According to an embodiment, the toner includes a charge controlling agent.

Specific examples of usable charge controlling agents include, but are not limited to, nigrosine dyes, azine dyes having an alkyl group having 2 to 16 carbon atoms described in Examined Japanese Application Publication No. 42-1627, the disclosures thereof being incorporated herein by reference; basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000)) and lake pigments thereof; quaternary ammonium salts (e.g., C.I. Solvent Black 8 (C.I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478, the disclosures thereof being incorporated herein by reference; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385, the disclosures thereof being incorporated herein by reference; sulfonated copper phthalocyanine pigments; organic boron salts; fluorine-containing quaternary ammonium salts; and calixarene compounds. Two or more of these materials can be used in combination. When the toner includes a colorant other than black, a whitish charge controlling agent, such as a metal salt of a salicylic acid derivative, may be used so that the colorant can express its color.

In some embodiments, the content of the charge controlling agent is within a range from 0.01 to 2 parts by weight, or from 0.02 to 1 part by weight, based on 100 parts of the binder resin. When the content of the charge controlling agent is 0.01 parts by weight or more, good charge controllability is provided. When the content of charge controlling agent is 2 parts by weight or less, the toner is neither excessively charged nor excessively electrostatically attracted to a developing roller, preventing deterioration of fluidity and image density while keeping good charge controllability.

According to an embodiment, the toner includes a layered inorganic mineral in which at least a part of interlayer ions are modified with organic ions (hereinafter "modified layered inorganic mineral"). Specific examples of such modified layered inorganic minerals include, but are not limited to, organic-cation-modified smectite-based materials. Metal anions can be introduced to a layered inorganic mineral by replacing a part of divalent metals with trivalent metals. In this case, at least a part of the introduced metal anions may be modified with an organic anion so as not to increase hydrophilicity of the layered inorganic mineral.

Specific materials usable as organic cation modifying agents include, but are not limited to, quaternary alkyl ammonium salts, phosphonium salts, and imidazolium salts. In one or more embodiments, quaternary alkyl ammonium salts are used. Specific examples of the quaternary alkyl ammonium salts include, but are not limited to, trimethyl stearyl ammonium, dimethyl stearyl benzyl ammonium, and oleylbis(2-hydroxyethyl)methyl ammonium.

Specific materials usable as organic anion modifying agents include, but are not limited to, sulfates, sulfonates, carboxylates, and phosphates having a branched, non-branched, or cyclic alkyl (C1-C44), alkenyl (C1-C22), alkoxy (C8-C32), hydroxyalkyl (C2-C22), ethylene oxide, or propylene oxide. In one or more embodiments, carboxylic acids having an ethylene oxide skeleton are used.

The modified layered inorganic mineral has proper hydrophobicity due to the modification by the organic ion. Because the organic solvent solution or dispersion (O1) or (O2) including the modified layered inorganic mineral expresses non-Newtonian viscosity, it is capable of controlling or varying the resulting toner shape. In some embodiments, the content of the modified layered inorganic mineral in the organic solvent solution or dispersion (O1) or (O2) is within a range from 0.05 to 10% by weight or from 0.05 to 5% by weight.

Specific examples of the modified layered inorganic minerals include, but are not limited to, montmorillonite, bentonite, hectorite, attapulgite, sepiolite, and mixtures thereof. In some embodiments, an organic-modified montmorillonite or bentonite is used. They can easily control viscosity of the organic solvent solution or dispersion (O1) or (O2) at a small amount without adversely affecting other toner properties.

Specific examples of commercially available organic-cation-modified layered inorganic minerals include, but are not limited to, quaternium 18 bentonite such as BENTONE® 3, BENTONE® 38, and BENTONE® 38V (from Rheox), TIXOGEL VP (from United Catalyst), and CLAYTONE® 34, CLAYTONE® 40, and CLAYTONE® XL (from Southern Clay Products); stearalkonium bentonite such as BENTONE® 27 (from Rheox), TIXOGEL LG (from United Catalyst), and CLAYTONE® AF and CLAYTONE® APA (from Southern Clay Products); and quaternium 18/benzalkonium bentonite such as CLAYTONE® HT and CLAYTONE® PS (from Southern Clay Products). In some embodiments, CLAYTONE® AF or CLAYTONE® APA is used.

Specific examples of commercially available organic-anion-modified layered inorganic minerals include, but are not limited to, HITENOL 330T (from Dai-ichi Kogyo Seiyaku Co., Ltd.) obtainable by modifying DHT-4A (from Kyowa Chemical Industry Co., Ltd.) with an organic anion represented by the following formula:

$$R1(OR2)_nOSO_3M$$

wherein R1 represents an alkyl group having 13 carbon atoms, R2 represents an alkylene group having 2 to 6 carbon atoms, n represents an integer within a range from 2 to 10, and m represents a monovalent metal element.

According to an embodiment, the toner includes a colorant such as a pigment and a dye.

Specific examples of usable yellow colorants include, but are not limited to, Cadmium Yellow, Mineral Fast Yellow, Nickel Titanium Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake. Specific examples of usable orange colorants include, but are not limited to, Molybdenum Orange, Permanent Orange GTR, Pyrazolone Orange, Vulcan Orange, Indanthrene Brilliant Orange RK, Benzidine Orange G, and Indanthrene Brilliant Orange GK. Specific examples of usable red colorants include, but are not limited to, colcothar, Cadmium Red, Permanent Red 4R, Lithol Red, Pyrazolone Red, Watching Red calcium salt, Lake Red D, Brilliant Carmine 6B, Eosin Lake, Rhodamine Lake B, Alizarin Lake, and Brilliant Carmine 3B. Specific examples of usable violet colorants include, but are not limited to, Fast Violet B and Methyl Violet Lake. Specific examples of usable blue colorants include, but are not limited to, Cobalt Blue, Alkali Blue, Victoria Blue Lake, Phthalocyanine Blue, metal-free Phthalocyanine Blue, partially-chlorinated Phthalocyanine Blue, Fast Sky Blue, and Indanthrene Blue BC. Specific examples of usable green colorants include, but are not limited to, Chrome Green, chromium oxide, Pigment Green B, and Malachite Green.

Specific examples of usable black colorants include, but are not limited to, azine dyes, metal salt azine dyes, metal oxides, and complex metal oxides, such as carbon black, oil furnace black, channel black, lamp black, acetylene black, and aniline black.

Two or more of these materials can be used in combination.

In some embodiments, the content of the colorant in the toner is within a range from 1 to 15% by weight or from 3 to 10% by weight. When the colorant content is less than 1% by weight, coloring power of the toner may be poor. When the colorant content is greater than 15% by weight, coloring power and electric property of the toner may be poor because the colorant cannot be uniformly dispersed in the toner.

The colorant can be combined with a resin to be used as a master batch. Specific examples of usable resins include, but are not limited to, polyester, polymers of styrene or styrene derivatives, styrene-based copolymers, polymethyl methacrylate, polybutyl methacry late, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination. In some embodiments, a polymer of styrene or a styrene derivative is used.

Specific examples of usable polymers of styrene or styrene derivatives include, but are not limited to, polystyrene, poly (p-chlorostyrene), and polyvinyl toluene. Specific examples of usable styrene-based copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The master batch can be obtained by mixing and kneading a resin and a colorant while applying a high shearing force. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used.

According to an embodiment, the toner includes a release agent. Specific examples of usable release agents include, but are not limited to, free-fatty-acid-free carnauba wax, polyethylene wax, montan wax, oxidized rice wax, and combinations thereof. In some embodiments, a microcrystalline carnauba wax having an acid value of 5 or less which can be dispersed in the binder resin with a dispersion diameter of 1 μm or less is used. In some embodiments, a microcrystalline montan wax having an acid value within a range from 5 to 14 obtained by purifying a mineral is used. In some embodiments, an oxidized rice wax having an acid value within a range from 10 to 30 obtained by oxidizing a rice bran wax with air is used. These waxes can be finely dispersed in the resin and can provide a toner having a good combination of hot offset resistance, transferability, and durability. Two or more kinds of the above waxes can be used in combination.

Specific materials usable as the release agent further include, but are not limited to, solid silicone wax, higher fatty acid higher alcohol, montan ester wax, polyethylene wax, polypropylene wax, and combinations thereof.

In some embodiments, the release agent has a glass transition temperature (Tg) within a range from 70 to 90° C. When Tg is less than 70° C., heat-resistant storage stability of the toner may be poor. When Tg is greater than 90° C., cold-offset resistance of the toner may be poor, i.e., the toner may not be releasable at low temperatures and undesirably winds around a fixing member.

In some embodiments, the content of the release agent in the toner is within a range from 1 to 20% by weight or from 3 to 10% by weight. When the content of the release agent is less than 1% by weight, offset resistance of the toner may be poor. When the content of the release agent is greater than 20% by weight, transferability and durability of the toner may be poor.

In some embodiments, the ratio (Dv/Dn) of the volume average particle diameter (Dv) to the number average particle diameter (Dn) of the toner is 1.14 or less.

According to an embodiment, the toner is manufactured through the following processes (1) to (4).

(1) A process in which toner constituents including a binder resin and a colorant are dissolved or dispersed in an organic solvent to prepare a solution or dispersion liquid of the toner constituents.

(2) A process in which the solution or dispersion liquid of the toner constituents is emulsified in an aqueous medium to from liquid droplets.

(3) A process in which the liquid droplets are associated.

(4) A process in which the organic solvent is removed from the solution or dispersion liquid of the toner constituents.

A developer according to an embodiment includes the above-described toner and other components such as a carrier. The developer may be either a one-component developer or a two-component developer. The two-component developer is compatible with high-speed printers, in accordance with recent improvement in information processing speed, owing to its long lifespan.

The carrier may comprise a core material and a resin layer that covers the core material. Specific examples of usable core materials include, but are not limited to, manganese-strontium (Mn—Sr) and manganese-magnesium (Mn—Mg) materials having a magnetization within a range from 50 to 90 emu/g. High magnetization materials such as iron powders having a magnetization of 100 emu/g or more and magnetites having a magnetization within a range from 75 to 120 emu/g are suitable for improving image density. Additionally, low magnetization materials such as copper-zinc (Cu—Zn) materials having a magnetization within a range from 30 to 80 emu/g are suitable for producing a high-quality image, because carriers made of such materials can weakly contact a photoreceptor. Two or more of these materials can be used in combination.

In some embodiments, the core material has a weight average particle diameter (D50) within a range from 10 to 200 μm or from 40 to 100 μm. When the weight average particle diameter is less than 10 μm, it means that the resulting carrier particles include a relatively large amount of fine particles, and therefore the magnetization per carrier particle is too low to prevent carrier particles from scattering. When the volume average particle diameter is greater than 200 μm, it means that the specific surface area of the carrier particle is too small to prevent toner particles from scattering. Therefore, solid portions in full-color images may not be reliably reproduced.

Specific examples of usable resins for the resin layer include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidene fluoride-acrylic monomer copolymer, vinylidene fluoride-vinyl fluoride copolymer, tetrafluoroethylene-vinylidene fluoride-non-fluoride monomer terpolymer, and silicone resins. Two or more of these resins can be used in combination. In one or more embodiments, a silicone resin is used.

The silicone resin may be, for example, a straight silicone resin consisting of organosiloxane bonds; or a alkyd-modified, polyester-modified, epoxy-modified, acrylic-modified, or urethane-modified silicone resin.

Specific examples of commercially available silicone resins include, but are not limited to, KR271, KR255, and KR152 (from Shin-Etsu Chemical Co., Ltd.); and SR2400, SR2406, and SR2410 (from Dow Corning Toray Co., Ltd.).

Specific examples of commercially available modified silicone resins include, but are not limited to, KR206 (alkyd-modified), KR5208 (acrylic-modified), ES1001N (epoxy-modified), and KR305 (urethane-modified) (from Shin-Etsu Chemical Co., Ltd.); and SR2115 (epoxy-modified) and SR2110 (alkyd-modified) (from Dow Corning Toray Co., Ltd.).

The silicone resin can be used alone or in combination with other components such as a cross-linkable component and a charge controlling component.

The resin layer may include a conductive powder such as metal, carbon black, titanium oxide, tin oxide, and zinc oxide. In some embodiments, the conductive powder has a volume average particle diameter of 1 μm or less. When the volume average particle diameter is greater than 1 μm, it may be difficult to control electric resistivity of the resin layer.

The resin layer can be formed by, for example, dissolving a resin (e.g., a silicone resin) in an organic solvent to prepare a coating liquid, and uniformly applying the coating liquid on the surface of the core material, followed by drying and baking. The coating method may be, for example, dip coating, spray coating, or brush coating.

Specific examples of usable organic solvents include, but are not limited to, toluene, xylene, methyl ethyl ketone, methyl isobutyl ketone, cellosolve, and butyl acetate.

The baking method may be either an external heating method or an internal heating method that uses a stationary electric furnace, a fluid electric furnace, a rotary electric furnace, a burner furnace, or microwave.

In some embodiments, the content of the resin layer in the carrier is within a range from 0.01 to 5.0% by weight. When the content of the resin layer is less than 0.01% by weight, it means that the resin layer cannot be uniformly formed on the core material. When the content of the resin layer is greater than 5.0% by weight, it means that the resin layer is so thick that each carrier particles are fused with each other.

In some embodiments, the two-component developer includes the toner in an amount of from 1 to 10.0 parts by weight based on 100 parts by weight of the carrier.

In accordance with some embodiments, the above-described toner can be used for an image forming apparatus including an electrostatic latent image bearing member (e.g., a photoreceptor); a charger for charging a surface of the electrostatic latent image bearing member; an irradiator for irradiating the charged surface of the electrostatic latent image bearing member with light; a developing device for developing the electrostatic latent image into a toner image that is visible with the toner; a transfer device for transferring the toner image from the electrostatic latent image bearing member onto a recording medium; and a fixing device for fixing the toner image on the recording medium.

FIG. 1 is a schematic view of an image forming apparatus for which the toner can be used. The image forming apparatus illustrated in FIG. 1 is a full-color electrophotographic copier employing a tandem-type indirect transfer method.

Figure 2:
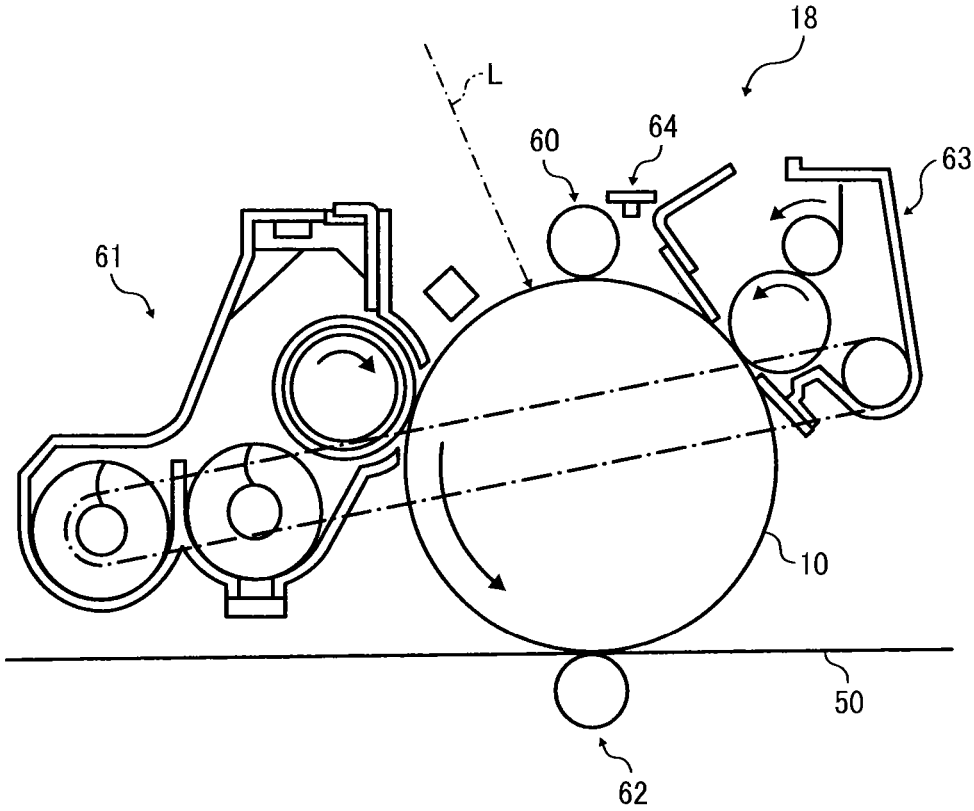
FIG. 2 is a magnified view of a tandem image forming part of the image forming apparatus illustrated in FIG. 1.

FIG. 2 is a magnified view of a tandem image forming part of the image forming apparatus illustrated in FIG. 1.

The image forming apparatus includes a main body 150, a paper feed table 200 disposed below the main body 150, a scanner (a reading optical system) 300 disposed above the main body 150, and an automatic document feeder (ADF) 400 disposed above the scanner 300. A seamless-belt intermediate transfer member 50 is disposed at the center of the main body 150. The intermediate transfer member 50 is stretched across support rollers 14, 15, and 16 to be rotatable clockwise in FIG. 2. An intermediate transfer member cleaner 17 that removes residual toner particles remaining on the intermediate transfer member 50 is disposed on the left side of the support roller 15 in FIG. 2. Four image forming units 18Y, 18C, 18M, and 18K that produce respective images of yellow, cyan, magenta, and black are disposed along a surface of the intermediate transfer member 50 stretched between the support rollers 14 and 15, thus forming a tandem image forming part 120. An irradiator 21 is disposed immediately above the tandem image forming part 120. A secondary transfer device 22 is disposed on the opposite side of the tandem image forming part 120 relative to the intermediate transfer member 50. The secondary transfer device 22 includes a seamless secondary transfer belt 24 stretched between two rollers 23. The secondary transfer belt 24 is pressed against the support roller 16 with the intermediate transfer member 50 therebetween so that an image is transferred from the intermediate transfer member 50 onto a sheet of a recording medium. A fixing device 25 that fixes a toner image on the sheet is disposed adjacent to the secondary transfer device 22. The fixing device 25 includes a seamless fixing belt 26 and a pressing roller 27. The fixing belt 26 is pressed against the pressing roller 27. The secondary transfer device 22 has a function of conveying the sheet having the toner image thereon to the fixing device 25. A sheet reversing device 28 that reverses a sheet upside down is disposed below the secondary transfer device 22 and the fixing device 25 and in parallel with the tandem image forming part 120.

To make a copy, a document is set on a document table 130 of the automatic document feeder 400. Alternatively, a document is set on a contact glass 32 of the scanner 300 while the automatic document feeder 400 is lifted up, followed by holding down of the automatic document feeder 400. Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to the document, and reflects a light reflected from the document toward the second runner 34. A mirror in the second runner 34 reflects the light toward a reading sensor 36 through an imaging lens 35. Thus, the document is read. On the other hand, upon pressing of the switch, one of the support rollers 14, 15, and 16 is driven to rotate by a driving motor and the other two support rollers are driven to rotate by rotation of the rotating support roller so as to rotate and convey the intermediate transfer member 50. In the image forming units 18Y, 18C, 18M, and 18K, single-color toner images of yellow, cyan, magenta, and black are formed on respective photoreceptors 10Y, 10C, 10M, and 10K.

The single-color toner images are sequentially transferred onto the intermediate transfer member 50 as the intermediate transfer member 50 is conveyed, thus forming a composite full-color toner image thereon.

On the other hand, upon pressing of the switch, one of paper feed rollers 142 starts rotating in the paper feed table 200 so that a sheet of a recording medium is fed from one of paper feed cassettes 144 in a paper bank 143. The sheet is separated by one of separation rollers 145 and fed to a paper feed path 146. Feed rollers 147 feed the sheet to a paper feed path 148 in the main body 100. The sheet is stopped by a registration roller 49. The registration roller 49 feeds the sheet to between the intermediate transfer member 50 and the secondary transfer device 22 in synchronization with an entry of the composite full-color toner image formed on the intermediate transfer member 50. The sheet is then fed to the fixing device 25 so that the composite full-color toner image is fixed thereon by application of heat and pressure. The sheet having the fixed toner image is switched by a switch claw 55 and discharged onto a discharge tray 57 by a discharge roller 56. Alternatively, the switch claw 55 switches paper feed paths so that the sheet gets reversed in the sheet reversing device 28. After forming another toner image on the back side of the sheet, the sheet is discharged onto the discharge tray 57 by rotating the discharge roller 56. On the other hand, the intermediate transfer member cleaner 17 removes residual toner particles remaining on the intermediate transfer member 50 without being transferred. Thus, the tandem image forming part 120 gets ready for next image formation.

Referring to FIG. 2, in each of the image forming units 18Y, 18C, 18M, and 18K (hereinafter any of them may be referred to as "image forming unit 18"), a charger 60, a developing device 61, a primary transfer device 62, a photoreceptor cleaner 63, and a neutralizer 64 are disposed around the respective photoreceptors 10Y, 10C, 10M, and 10K (hereinafter any of them may be referred to as "photoreceptor 10"). The photoreceptor cleaner 63 includes a blade member.

In accordance with some embodiments, an image forming method is provided. The method includes a charging process in which a surface of an electrostatic latent image bearing member is charged; an irradiating process in which the charged surface of the electrostatic latent image bearing member is irradiated with light to form an electrostatic latent image thereon; a developing process in which the electrostatic latent image is developed into a toner image that is visible with the above-described toner; a transfer process in which the toner image is transferred from the electrostatic latent image bearing member onto a recording medium; and a fixing process in which the toner image is fixed on the recording medium.

In accordance with some embodiments, a process cartridge is provided. The process cartridge includes an electrostatic latent image bearing member and a developing device containing the above-described toner and is detachably attachable to image forming apparatuses.

Figure 3:
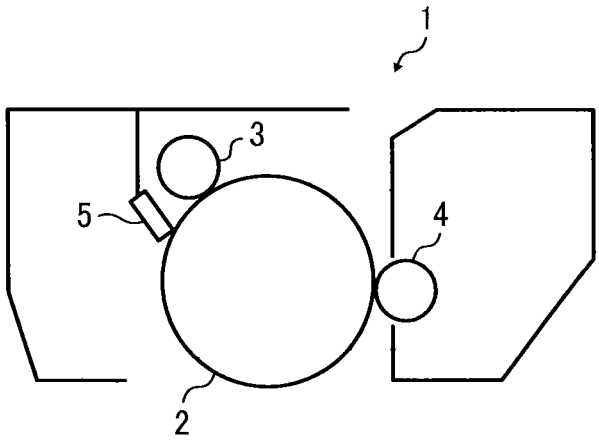
FIG. 3 is a schematic view of a process cartridge according to an embodiment.

FIG. 3 is a schematic view of a process cartridge according to an embodiment. A process cartridge 1 includes a photoreceptor 2, a charger 3, a developing device 4, and a cleaner 5. According to an embodiment, the process cartridge integrally supports at least the photoreceptor 2 and the developing device 4 containing the above-described toner and is detachably attachable to image forming apparatuses.

The process cartridge illustrated in FIG. 3 operates as follows.

First, the photoreceptor 2 is driven to rotate at a predetermined peripheral speed. A peripheral surface of the photoreceptor 2 is uniformly charged to a predetermined positive or negative potential by the charger 3 and then irradiated with light by means of slit exposure or laser beam scanning while the photoreceptor 2 is rotating. As a result, electrostatic latent images are sequentially formed on the peripheral surface of the photoreceptor 2. The electrostatic latent images are developed into toner images by the developing device 4. The toner images are sequentially transferred onto a recording medium fed from a paper feed part in synchronization with rotation of the photoreceptor 2. The recording medium having the toner image thereon is separated from the peripheral surface of the photoreceptor 2 and introduced into a fixing device. The recording medium having the fixed toner image thereon is discharged from the image forming apparatus as a copy. The cleaner 5 removes residual toner particles remaining on the peripheral surface of the photoreceptor 2 without being transferred. The cleaned photoreceptor 2 is neutralized to be ready for a next image forming operation.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Preparation of Polyester Resin Particles

Preparation of Polyester Resin [a-1]

In an autoclave reaction vessel, heat a mixture of 1,600 parts of terephthalic acid, 633 parts of isophthalic acid, 1,149 parts of ethylene glycol, and 1,510 parts of neopentyl glycol at 260° C. for 5 hours to cause an esterification reaction. After adding 0.262 parts of germanium dioxide as a catalyst, increase the reaction system temperature to 280° C. over a period of 30 minutes and gradually reduce the reaction system pressure to 0.1 Torr over a period of 1 hour. Allow the polycondensation reaction to continue for 5 hours. Return the reaction system pressure to normal pressure by introducing nitrogen gas and reduce the reaction system temperature to 260° C. Thereafter, further add 50 parts of isophthalic acid and 26.6 parts of trimellitic anhydride to the vessel and agitate the mixture at 255° C. for 30 minutes, thus obtaining a sheet-like resin. Cool the sheet-like resin to room temperature and pulverize it into particles. Sieve the particles and obtain those collected with sieves having openings of 1 to 6 mm as a polyester resin [a-1].

Preparation of Polyester Resins [a-2] to [a-16]

Repeat the procedure for preparing the polyester resin [a-1] except for changing the raw material compositions as described in Table 1 and properly adjusting the reaction time, amount of catalyst, and reaction system temperature, to prepare polyester resins [a-2] to [a-16].

TABLE 1

| | Acid components | | | | | Alcohol components | | | |
|---|---|---|---|---|---|---|---|---|---|
| Polyester resin No. | Terephthalic acid (mol) | Isophthalic acid (mol) | Trimellitic anhydride (mol) | Phthalic acid (mol) | Adipic acid (mol) | Ethylene glycol (mol) | Neopentyl glycol (mol) | Mw | Tg (° C.) |
| a-1 | 60.2 | 25.7 | 1 | 0 | 0 | 43.2 | 56.8 | 97,800 | 55 |
| a-2 | 80.1 | 15.3 | 14 | 0 | 0 | 39.2 | 60.8 | 89,100 | 58 |
| a-3 | 79 | 10.1 | 2 | 0 | 0 | 43.6 | 51 | 72,500 | 56 |
| a-4 | 77.9 | 22.5 | 0 | 0 | 0 | 42.1 | 57.9 | 68,800 | 59 |
| a-5 | 80.1 | 15.7 | 3 | 0 | 0 | 44 | 56 | 51,200 | 62 |
| a-6 | 69.8 | 25.7 | 11 | 1.3 | 0 | 46.2 | 53.8 | 43,900 | 57 |
| a-7 | 65.2 | 15.3 | 2 | 14.4 | 0 | 46.9 | 53.1 | 29,000 | 68 |
| a-8 | 60.2 | 14 | 4 | 12 | 12 | 45 | 55 | 24,300 | 63 |
| a-9 | 79 | 10.1 | 1 | 0 | 0 | 43.2 | 56.8 | 21,100 | 58 |
| a-10 | 77.9 | 22.5 | 14 | 0 | 0 | 39.2 | 59 | 19,300 | 58 |
| a-11 | 73.2 | 15.7 | 5 | 0 | 0 | 44.6 | 55.4 | 15,100 | 56 |
| a-12 | 95.1 | 10.1 | 0 | 0 | 0 | 42.1 | 57.9 | 9,500 | 59 |
| a-13 | 80.1 | 22.9 | 1 | 0 | 0 | 43.6 | 56.4 | 8,500 | 58 |
| a-14 | 79 | 15.7 | 13 | 1.3 | 0 | 45 | 55 | 6,000 | 61 |
| a-15 | 77.9 | 18.3 | 2 | 13 | 0 | 46.9 | 53.1 | 4,000 | 68 |
| a-16 | 65.2 | 19 | 3 | 12 | 11.3 | 42 | 58 | 19,300 | 64 |

Preparation of Polyester Resin Particle Dispersion [w-1]

In a 2-L glass container equipped with a jacket, agitate a mixture of 200 parts of the polyester resin [a-1], 35 parts of ethylene glycol mono-n-butyl ether, 450 parts of a 0.5% aqueous solution of a polyvinyl alcohol (UNITIKA POVAL 050G from Unitika, Ltd.), and N,N-dimethylethanolamine in an amount 1.2 times the equivalent amount of carboxyl groups in the polyester resin [a-1] with a desktop disperser (TK ROBOMIX from PRIMIX Corporation) at a revolution of 6,000 rpm in an open system. The resulting resin particles are suspended without settling down.

Keep agitating the mixture for 10 minutes and flow hot water within the jacket to heat the container. Increase the revolution to 7,000 rpm at the time the inner temperature of the container reaches 68° C. Further agitate the mixture for 20 minutes while keeping the inner temperature within a range from 68 to 70° C., thus obtaining a uniform water dispersion that is milky white. Flow cold water within the jacket to cool the water dispersion to room temperature while agitating it at a revolution of 3,500 rpm. Filter the water dispersion with a stainless-steel filter (a plain-woven 635 mesh). As a result, few resin particles are remaining on the filter. Thus, a polyester resin particle dispersion [w-1] is obtained. Properties are shown in Table 2.

Preparation of Polyester Resin Particle Dispersions [w-2] to [w-16]

Repeat the procedure for preparing the polyester resin particle dispersion [w-1] except for changing the raw material compositions as described in Table 2 to prepare polyester resin particle dispersions [w-2] to [w-16]. Properties are shown in Table 2.

TABLE 2

| Polyester resin particle dispersion No. | Raw materials: Polyester resin (a) No. | Polyester resin (a) Amount (parts) | N,N-dimethylethanolamine (eq/—COOH) | Triethylamine (eq/—COOH) | Ethylene glycol mono-n-butyl ether (parts) | PVA-1 (parts) | Solid contents (%) | Dv (nm) |
|---|---|---|---|---|---|---|---|---|
| w-1 | a-1 | 200 | 1.2 | 0 | 35 | 450 | 30.1 | 55 |
| w-2 | a-2 | 200 | 1.1 | 0.5 | 36 | 455 | 30 | 20 |
| w-3 | a-3 | 200 | 0 | 0.6 | 32 | 459 | 29.8 | 42 |
| w-4 | a-4 | 200 | 1.3 | 0.2 | 31 | 460 | 29.9 | 12 |
| w-5 | a-5 | 200 | 1.2 | 0 | 45 | 470 | 29.7 | 52 |
| w-6 | a-6 | 200 | 1.2 | 0 | 35 | 450 | 30.1 | 61 |
| w-7 | a-7 | 200 | 1.1 | 0.5 | 36 | 455 | 30 | 49 |
| w-8 | a-8 | 200 | 0 | 0.6 | 32 | 459 | 29.8 | 44 |
| w-9 | a-9 | 200 | 1.3 | 0.2 | 31 | 460 | 30.1 | 39 |
| w-10 | a-10 | 200 | 1.2 | 0 | 45 | 470 | 30 | 56 |
| w-11 | a-11 | 200 | 1.4 | 0.4 | 42 | 449 | 29.8 | 52 |
| w-12 | a-12 | 200 | 1 | 1 | 39 | 456 | 29.9 | 18 |
| w-13 | a-13 | 200 | 0.9 | 1.6 | 38 | 462 | 29.7 | 55 |
| w-14 | a-14 | 200 | 1.1 | 0.5 | 36 | 455 | 29.9 | 48 |
| w-15 | a-15 | 200 | 0.2 | 0.5 | 32 | 459 | 30.1 | 50 |
| w-16 | a-16 | 200 | 1.3 | 0.3 | 31 | 460 | 29.9 | 11 |

Evaluation of Polyester Resin Particles

Ethyl acetate solubility of each polyester resin particle is determined as follows. First, charge a vial with 3 parts of ethyl acetate, 4 parts of purified water (having a pH of 2.3), and each polyester resin particle in an amount 1.5% by weight of the amount of the ethyl acetate. Shake the resulting mixture liquid with a hand for 40 to 50 times and allow it to stand for 10 minutes. Take out the water phase from the mixture liquid and subject it for a measurement of transmittance (defined by the later-described formula) at a wavelength of 600 nm with a spectrophotometer. Determine the degree of ethyl acetate solubility of the polyester resin particle based on the transmittance measured above according to Table 3. When the polyester resin particles is not dissolved, the resulting mixture liquid forms a suspension liquid that does not transmit light. As the solubility of the polyester resin particle increases, the degree of suspension of the mixture liquid decreases and transparency thereof increases.

$$\text{Transmittance (\%)}=(I/10)\times 100$$

wherein I represents a transmitted light flux and 10 represents an incident light flux.

TABLE 3

| Ethyl acetate solubility of polyester resin particles (Rank) | Transmittance (%) |
|---|---|
| 5 | 90 or more |
| 4 | 60 or more and less than 90 |
| 3 | 40 or more and less than 60 |
| 2 | 20 or more and less than 40 |
| 1 | 10 or more and less than 20 |
| 0 | less than 10 |

The index of ethyl acetate solubility of polyester resin particle is summarized in Table 4.

TABLE 4

| | Ethyl acetate solubility of polyester resin particles (Rank) |
|---|---|
| High (Soluble) | 5 |
| ↑ | 4 |
| | 3 |
| | 2 |
| ↓ | 1 |
| Low (Insoluble) | 0 |

Particle size distribution stability of each polyester resin particle is determined according to Table 5.

The particle size distribution stability time is defined as a time period within which Dv/Dn is stably maintained (i.e., Dv/Dn does not fluctuate beyond a range from −0.03 to +0.03) for 30 seconds and then increases by 0.02 or more.

TABLE 5

| | Particle size distribution Stability (Rank) | Particle size distribution stability time |
|---|---|---|
| High (Soluble) | 5 | 30 min or more |
| ↑ | 4 | 20 min or more and less than 30 min |
| | 3 | 10 min or more and less than 20 min |
| | 2 | 1 min or more and less than 10 min |
| ↓ | 1 | less than 1 min |
| Low (Insoluble) | 0 | |

Ethyl acetate solubility, particle size distribution stability, weight average molecular weight (Mw), and volume average particle diameter (Dv) of the polyester resin particles used for preparation of toners (described below) are shown in Table 6.

TABLE 6

| | | Properties of polyester resin (a) | | | |
|---|---|---|---|---|---|
| | Toner No. | Ethyl acetate solubility (Rank) | Particle size distribution stability (Rank) | Mw | Dv (nm) |
| Example 1 | 1 | 0 | 5 | 97,800 | 55 |
| Example 2 | 2 | 1 | 5 | 89,100 | 20 |
| Example 3 | 3 | 1 | 5 | 72,500 | 42 |
| Example 4 | 4 | 2 | 4 | 68,800 | 12 |
| Example 5 | 5 | 2 | 4 | 51,200 | 52 |
| Example 6 | 6 | 2 | 4 | 43,900 | 61 |
| Example 7 | 7 | 2 | 4 | 29,000 | 49 |
| Example 8 | 8 | 3 | 3 | 24,300 | 44 |
| Example 9 | 9 | 3 | 3 | 21,100 | 39 |
| Example 10 | 10 | 3 | 3 | 19,300 | 56 |
| Example 11 | 11 | 4 | 3 | 15,100 | 52 |
| Example 12 | 12 | 4 | 2 | 9,500 | 18 |
| Comparative Example 1 | 13 | 5 | 1 | 8,500 | 55 |
| Comparative Example 2 | 14 | 5 | 1 | 6,000 | 48 |
| Comparative Example 3 | 15 | 5 | 1 | 4,000 | 50 |
| Comparative Example 4 | 16 | 4 | 1 | 19,300 | 11 |

Preparation of Aqueous Media 1 to 16

Uniformly mix and agitate 300 parts of ion-exchange water, 300 parts of the polyester resin particle dispersion [w-1], and 0.2 parts of sodium dodecylbenzenesulfonate. Thus, an aqueous medium 1 is prepared.

In a similar manner, aqueous media 2 to 16 are prepared from the polyester resin particle dispersions [w-2] to [w-16], respectively.

Preparation of Mother Toners 1 to 16

Dissolve an amount of a polylactic acid (VYLOECOL BE-410 from Toyobo Co., Ltd.), to be formed into the resin particle (B), in ethyl acetate. Thus, a resin solution 1 containing 50% by weight of the polylactic acid is prepared.

Disperse 5 parts of a carnauba wax (having a molecular weight of 1,800, an acid value of 2.7 mgKOH/g) and 5 parts of a master batch in the resin solution 1 by a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 msec. Repeat this dispersing operation 3 times (3 passes). Further, add 2.5 parts of a ketimine compound to the resulting liquid. Thus, a toner components liquid is prepared.

In a vessel, mix and agitate 150 parts of the aqueous medium 1 with 100 parts of the toner components liquid by a TK HOMOMIXER (from PRIMIX Corporation) at a revolution of 12,000 rpm for 10 minutes. Thus, an emulsion slurry is prepared.

In a flask equipped with a stirrer and a thermometer, agitate 100 parts of the emulsion slurry at a peripheral speed of 20 m/min at 30° C. for 10 hours so that the solvents are removed therefrom. Thus, a dispersion slurry is prepared.

Next, filter 100 parts of the dispersion slurry under reduced pressures to obtain a wet cake (i). Mix the wet cake (i) with 100 parts of ion-exchange water by a TK HOMOMIXER at a revolution of 12,000 rpm for 10 minutes, followed by filtration, thus obtaining a wet cake (ii). Mix the wet cake (ii) with 300 parts of ion-exchange water by a TK HOMOMIXER at a revolution of 12,000 rpm for 10 minutes, followed by filtration. Repeat this operation twice, thus obtaining a wet cake (iii). Mix the wet cake (iii) with 20 parts of a 10% aqueous solution of sodium hydroxide by a TK HOMOMIXER at a revolution of 12,000 rpm for 30 minutes, followed by filtration under reduced pressures, thus obtaining a wet cake (iv). Mix the wet cake (iv) with 300 parts of ion-exchange water by a TK HOMOMIXER at a revolution of 12,000 rpm for 10 minutes, followed by filtration, thus obtaining a wet cake (v). Mix the wet cake (v) with 300 parts of ion-exchange water by a TK HOMOMIXER at a revolution of 12,000 rpm for 10 minutes, followed by filtration. Repeat this operation twice, thus obtaining a wet cake (vi). Mix the wet cake (vi) with 20 parts of a 10% hydrochloric acid by a TK HOMOMIXER at a revolution of 12,000 rpm for 10 minutes, and further mix with an amount of a 5% methanol solution of a fluorine-containing quaternary ammonium salt (FTERGENT F-310 from Neos Company Limited) for 10 minutes, followed by filtration, thus obtaining a wet cake (vii). The amount of the 5% methanol solution of a fluorine-containing quaternary ammonium salt is determined as such that the resulting mixture contains 0.1 parts of the fluorine-containing quaternary ammonium salt based on 100 parts of the solid contents. Mix the wet cake (vii) with 300 parts of ion-exchange water by a TK HOMOMIXER at a revolution of 12,000 rpm for 10 minutes, followed by filtration. Repeat this operation twice, thus obtaining a wet cake (viii). Dry the wet cake (viii) by a circulating drier at 40° C. for 36 hours and filter it with a mesh having an opening of 75 μm. Thus, a mother toner 1 is prepared.

In a similar manner, mother toners 2 to 16 are prepared from the aqueous media 2 to 16, respectively.

Preparation of Toners 1 to 16

Mix 100 parts of each of the mother toners 1 to 16 with 1.0 part of a hydrophobized silica (112000 from Clariant Japan K.K.) by a HENSCHEL MIXER (from Mitsui Mining Co., Ltd.) at a peripheral speed of 30 msec for 30 seconds, followed by a pause for 1 minute. Repeat this mixing operation 5 times (5 cycles). Sieve the mixture with a mesh having an opening of 35 μm. Thus, toners 1 to 16 are prepared.

Preparation of Carrier

Disperse 100 parts of a silicone resin (organo straight silicone), 5 parts of γ-(2-aminoethyl)aminopropyl trimethoxysilane, and 10 parts of a carbon black in 100 parts of toluene by a homomixer for 20 minutes. Thus, a resin layer coating liquid is prepared. Apply the resin layer coating liquid to the surfaces of 1,000 parts of magnetite particles having a volume average particle diameter of 50 μm by a fluidized bed coating device. Thus, a carrier is prepared.

Preparation of Developers

Mix 5 parts of each of the toners 1 to 16 with 95 parts of the carrier. Thus, developers 1 to 16 are prepared.

Dv, Dn, and Dv/Dn of the toners 1 to 16 are shown in Table 7.

TABLE 7

| | Toner No. | Dv | Dn | Dv/Dn |
|---|---|---|---|---|
| Example 1 | 1 | 5.1 | 4.8 | 1.06 |
| Example 2 | 2 | 5.3 | 5.0 | 1.07 |
| Example 3 | 3 | 5.4 | 5.1 | 1.07 |
| Example 4 | 4 | 5.2 | 4.9 | 1.07 |
| Example 5 | 5 | 5.5 | 5.0 | 1.10 |
| Example 6 | 6 | 5.1 | 4.6 | 1.11 |
| Example 7 | 7 | 5.2 | 4.7 | 1.11 |
| Example 8 | 8 | 5.3 | 4.8 | 1.10 |
| Example 9 | 9 | 5.2 | 4.7 | 1.11 |
| Example 10 | 10 | 5.0 | 4.5 | 1.12 |
| Example 11 | 11 | 5.1 | 4.5 | 1.13 |
| Example 12 | 12 | 5.4 | 4.8 | 1.14 |
| Comparative Example 1 | 13 | 5.1 | 4.3 | 1.19 |
| Comparative Example 2 | 14 | 5.2 | 4.3 | 1.21 |
| Comparative Example 3 | 15 | 5.3 | 4.5 | 1.18 |
| Comparative Example 4 | 16 | 5.1 | 4.3 | 1.19 |

Additional modifications and variations in accordance with further embodiments of the present invention are possible in light of the above teachings. It is therefore to be understood that within the scope of the appended claims the invention may be practiced other than as specifically described herein.

What is claimed is:

1. A toner, comprising:

a resin particle (C) comprising:

a resin particle (B) containing a resin (b), wherein the resin (b) has a polyhydroxycarboxylic acid skeleton; and a resin particle (A) or covering layer (P) which is adhered to a surface of the resin particle (B), wherein the resin particle (A) or covering layer (P) contains a resin (a), wherein the resin (a) is a polyester resin having at least one polybasic acid unit and at least one polyol unit, wherein the resin (a) has a weight average molecular weight from 9,500 to 100,000, and wherein the total polybasic acid units comprise 50% by mole or more of an aromatic polybasic acid and the total polyol units include 50% by mole or more of ethylene glycol and/or neopentyl glycol.

2. The toner according to claim 1, wherein a ratio (Dv/Dn) of a volume average particle diameter (Dv) to a number average particle diameter (Dn) of the toner is 1.14 or less.

3. The toner according to claim 1, wherein the polyhydroxycarboxylic acid skeleton is obtained from an optically-active monomer.

4. A method of manufacturing the toner according to claim 1, the method comprising:

preparing an aqueous dispersion (W) of the resin particle (A) including the resin (a);

preparing an organic solvent solution or dispersion (O1) of the resin (b) or an organic solvent solution or dispersion (O2) of a precursor (b0) of the resin (b);

dispersing the organic solvent solution or dispersion (O1) or (O2) in the aqueous dispersion (W) so that the resin particle (B) containing the resin (b) is formed in the aqueous dispersion (W) and the resin particle (A) containing the resin (a) is adhered to a surface of the resin particle (B); and removing the organic solvent.

5. The toner according to claim 4, wherein the resin particle (A) containing the resin (a) is dispersed in an aqueous medium in the presence of a basic compound.

6. A method of manufacturing the toner according to claim 1, comprising:

preparing the resin particle (B) containing g the resin (b); and coating the resin particle (B) with a coating agent containing the resin (a) or a precursor (a') of the resin (a).

7. A developer, comprising:

the toner according to claim 1; and no carrier.

8. A developer, comprising:

the toner according to claim 1; and a carrier.

9. A toner container, comprising:

a container body; and the toner according to claim 1 contained in the container body.

10. An image forming method, comprising:

charging a surface of an electrostatic latent image bearing member;

irradiating the charged surface of the electrostatic latent image bearing member with light to form an electrostatic latent image thereon;

developing the electrostatic latent image into a toner image that is visible with the toner according to claim 1;

transferring the toner image from the electrostatic latent image bearing member onto a recording medium; and fixing the toner image on the recording medium.

11. A process cartridge, comprising:

an electrostatic latent image bearing member; and a developing device containing the toner according to claim 1, wherein the developing device adapted to develop an electrostatic latent image formed on the electrostatic latent image bearing member into a toner image that is visible with the toner.

12. The toner according to claim 1, wherein the polyester resin has an acid value of from 10 to 40 mgKOH/g.

13. The toner according to claim 1, wherein the polyester resin has a relative viscosity of 1.20 or more, wherein the relative viscosity is measured at 20° C. by dissolving 1% by weight of the polyester resin in a mixed solvent in which an amount of phenol is mixed with the same amount of 1,1,2,2,-tetrachloroethane.

* * * * *